US008640655B2

(12) United States Patent
Furman

(10) Patent No.: US 8,640,655 B2
(45) Date of Patent: Feb. 4, 2014

(54) HIGH EFFICIENCY WOOD OR BIOMASS BOILER

(76) Inventor: Dale C. Furman, Portland, NY (US)

( * ) Notice: Subject to any disclaimer, the term of this patent is extended or adjusted under 35 U.S.C. 154(b) by 1184 days.

(21) Appl. No.: 12/319,227

(22) Filed: Jan. 2, 2009

(65) Prior Publication Data

US 2009/0183693 A1 Jul. 23, 2009

Related U.S. Application Data

(60) Provisional application No. 61/009,787, filed on Jan. 2, 2008.

(51) Int. Cl.
*F24H 1/00* (2006.01)

(52) U.S. Cl.
USPC ..... 122/16.1; 110/158; 126/286

(58) Field of Classification Search
USPC ..... 110/158; 126/285 R, 286, 287; 122/16.1
See application file for complete search history.

(56) References Cited

U.S. PATENT DOCUMENTS

| | | | | |
|---|---|---|---|---|
| 25,579 | A | 9/1859 | Paddock | |
| 1,527,153 | A | 2/1925 | Gray | |
| 1,636,537 | A | 7/1927 | Tryner | |
| 1,652,713 | A | 12/1927 | Fackler | |
| 1,821,204 | A | 9/1931 | Burroughs | |
| 1,928,272 | A * | 9/1933 | Sourber | 126/293 |
| 1,943,213 | A | 1/1934 | Dietz | |
| 2,352,057 | A | 6/1944 | Wingert | |
| 2,374,611 | A | 4/1945 | Martin et al. | |
| 2,443,910 | A | 6/1948 | Higley | |
| 2,444,402 | A | 6/1948 | Klein | |
| 4,027,602 | A * | 6/1977 | Mott | 110/203 |
| 4,047,515 | A | 9/1977 | Daniel | |
| 4,226,195 | A | 10/1980 | Lindroos | |
| 4,280,476 | A | 7/1981 | Webb | |
| 4,287,838 | A | 9/1981 | Frosch | |
| 4,309,965 | A * | 1/1982 | Hill | 122/16.1 |
| 4,313,418 | A | 2/1982 | Schrader | |
| 4,337,753 | A | 7/1982 | McGinn | |
| 4,388,082 | A | 6/1983 | Guttmann | |
| 4,394,132 | A | 7/1983 | Taylor | |
| 4,406,619 | A | 9/1983 | Oldengott | |
| 4,444,127 | A | 4/1984 | Spronz | |

(Continued)

OTHER PUBLICATIONS

Nussbaumer, T., "Combustion and Co-combustion of Biomass: Fundamentals, Technologies, and Primary Measures for Emission Reduction", Energy & Fuels, 2003, pp. 1510-1521, 17.

(Continued)

*Primary Examiner* — Craig Schneider
(74) *Attorney, Agent, or Firm* — Simpson & Simpson, PLLC

(57) ABSTRACT

A boiler including a water jacket surrounding upper and lower combustion chambers for receiving heat for heating water or other fluid therein, which chambers are defined by a refractory structure that extends entirely across the inner casing. A vertical passage through the refractory structure provides for flow of combustion gases from the upper to lower combustion chamber. Oxygen is provided through a first forced air inlet to the upper combustion chamber for burning of wood or biomass, and is provided through a forced air passage in the refractory structure and opening into the vertical passage thereby providing at least one second forced air inlet for burning of the combustion gases and particulates passing therethrough. The refractory structure sealingly engages the inner casing in a manner to seal the upper combustion chamber from the lower combustion chamber so that the upper combustion chamber can be made substantially air tight.

13 Claims, 15 Drawing Sheets

(56) References Cited

U.S. PATENT DOCUMENTS

| | | | | | |
|---|---|---|---|---|---|
| 4,473,351 | A | * | 9/1984 | Hill | 432/2 |
| 4,494,525 | A | | 1/1985 | Albertsen | |
| 4,498,909 | A | | 2/1985 | Milner | |
| 4,513,671 | A | | 4/1985 | Eshleman | |
| 4,531,464 | A | | 7/1985 | Eshleman | |
| 4,549,526 | A | | 10/1985 | Lunde | |
| 4,598,649 | A | | 7/1986 | Eshleman | |
| 4,601,730 | A | | 7/1986 | McGowan et al. | |
| 4,612,878 | A | * | 9/1986 | Schnurer | 122/16.1 |
| 4,635,899 | A | | 1/1987 | Eshleman | |
| 4,694,817 | A | | 9/1987 | Nilsson | |
| 4,779,795 | A | * | 10/1988 | Winmill | 237/8 R |
| 4,917,772 | A | | 4/1990 | Koschlig | |
| 5,226,927 | A | | 7/1993 | Rundstrom | |
| 5,289,787 | A | | 3/1994 | Eshleman | |
| 5,323,716 | A | | 6/1994 | Eshleman | |
| 5,338,144 | A | | 8/1994 | Eshleman | |
| 5,338,918 | A | | 8/1994 | Eshleman | |
| 5,353,719 | A | | 10/1994 | Eshleman et al. | |
| 5,361,709 | A | | 11/1994 | Eshleman | |
| 5,388,535 | A | | 2/1995 | Eshleman | |
| 5,399,323 | A | | 3/1995 | Paisley | |
| 5,417,170 | A | | 5/1995 | Eshleman | |
| 5,420,394 | A | | 5/1995 | Eshleman | |
| 5,428,205 | A | | 6/1995 | Eshleman | |
| 5,501,159 | A | | 3/1996 | Stevers et al. | |
| 5,551,958 | A | | 9/1996 | Antol, Jr. | |
| 5,586,855 | A | | 12/1996 | Eshleman | |
| 5,803,969 | A | | 9/1998 | Knop | |
| 5,920,168 | A | | 7/1999 | Lewis | |
| 6,024,932 | A | | 2/2000 | Paisley | |
| 6,050,204 | A | | 4/2000 | Stevers et al. | |
| 6,055,916 | A | | 5/2000 | Stevers et al. | |
| 6,067,979 | A | | 5/2000 | Jaasma et al. | |
| 6,176,188 | B1 | | 1/2001 | Stevers et al. | |
| 6,718,889 | B1 | | 4/2004 | Brazier et al. | |
| 6,802,974 | B2 | | 10/2004 | Rebholz et al. | |
| 6,968,678 | B2 | | 11/2005 | LeLeux et al. | |
| 7,144,558 | B2 | | 12/2006 | Smith et al. | |
| 7,214,252 | B1 | | 5/2007 | Krumm et al. | |
| 7,228,806 | B2 | | 6/2007 | Dueck et al. | |
| 7,241,322 | B2 | | 7/2007 | Graham | |
| 8,011,329 | B2 | * | 9/2011 | Hardy | 122/16.1 |
| 2005/0109603 | A1 | | 5/2005 | Graham | |
| 2006/0196398 | A1 | | 9/2006 | Graham | |
| 2007/0187223 | A1 | | 8/2007 | Graham | |
| 2008/0041357 | A1 | | 2/2008 | Brown | |

OTHER PUBLICATIONS

Seton Manufacturing, "Heating that doesn't cost the Earth", www.rohor.com/page3.html, Aug. 27, 2008.

Seton Manufacturing, "Heating that doesn't cost the Earth", www.rohor.com/page8.html, Sep. 26, 2007.

TARM USA, "Wood Gasification", www.woodboilers.com/wood-gasification-info.asp, Sep. 26, 2077.

TARM USA, "Wood, pellet and corn heating systems intelligently engineered by TARM USA", www.woodboilers.com/defaultasp, Sep. 26, 2007.

Greenwood, "Products", www.greenwoodfurnace.com/products.html, Sep. 26, 2007.

Greenwood, "FAQs", www.greenwoodfurnace.com/ProductFAQs.htm, Sep. 26, 2007.

Central Boiler, "Models", www.centralboiler.com/models.php, Sep. 26, 2007.

Alternate Heating Systems, "The Swirl Chamber", www.alternateheatingsystems.com/woodboilers.htm, Jun. 27, 2008.

Alternate Heating Systems, "Wood Gasification—the Process", www.alternateheatingsystems.com/woodgasification.htm, Sep. 10, 2008.

Alternate Heating Systems, "Why is heat storage not required with thee Wood Gun?", www.altemateheatingsystems.com/knowledgebase.php?search_fd3=heating+deman..., Sep. 10, 2008.

Alternate Heating Systems, "The Wood Gun versus Competitors", www.alternateheatingsystems.com/knowledgebase.php?search_fd3=Ulike+our_co..., Sep. 10, 2008.

Alternate Heating Systems, "During the Wood Gun shutdown phase, you say that heat is stored in the refractory lining and that re-ignition can occur as much as several hours afterward. This means that the gasification process must continue even during shutdown. What happens to the wood gases during the shutdown phase?", www.alternateheatingsystems.com/knowledgebase.php?search_fd1=2&search_fd3=, Sep. 10, 2008.

Alternate Heating Systems, "Can an Alternate Heating Systems boiler be used in a radiant heating system?", www.alternateheatingsystems.com/knowledgebase.php?search_fd1=1&search_fd3=, Sep. 10, 2008.

Alternate Heating Systems, "Particle Fuel Delivery for Industrial/Commercial Applications", www.alternateheatingsystems.com/woodboilers.htm, Sep. 10, 2008.

* cited by examiner

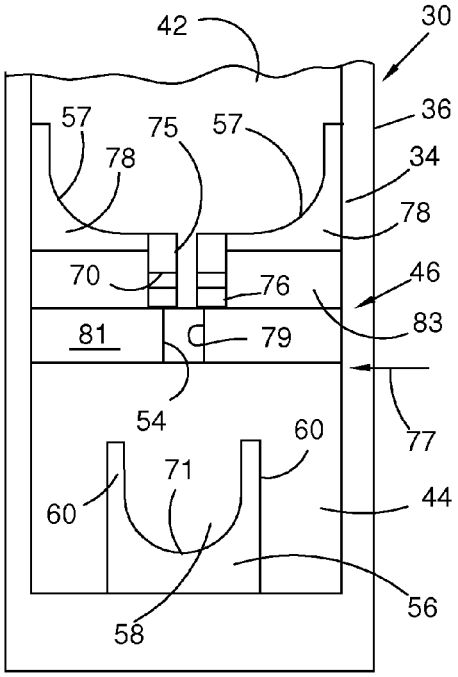
FIG. 28
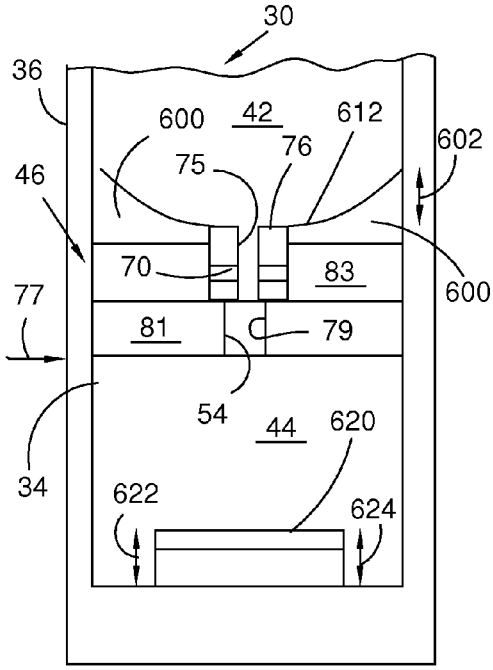
FIG. 29
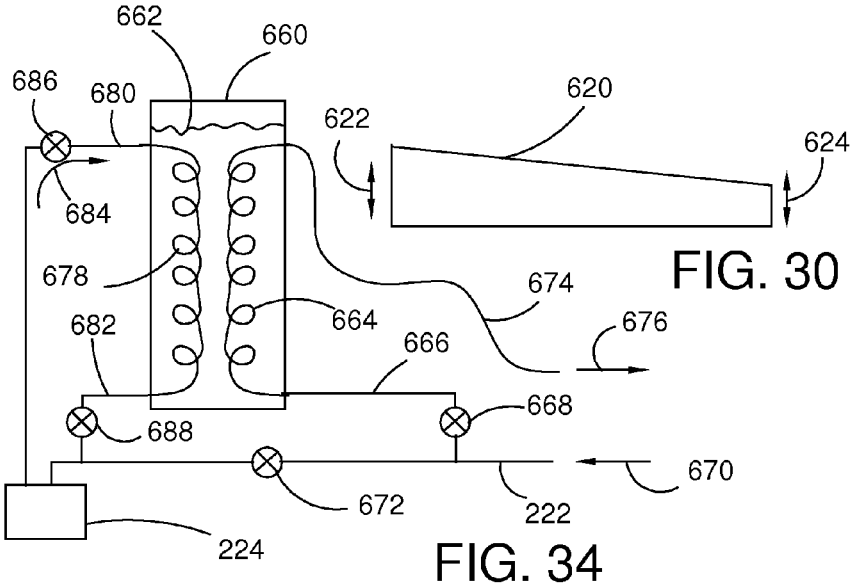
FIG. 30
FIG. 34

HIGH EFFICIENCY WOOD OR BIOMASS BOILER

The priority of U.S. provisional application Ser. No. 61/009,787, filed Jan. 2, 2008, which is hereby incorporated herein by reference, is hereby claimed.

The present invention relates generally to boilers. More particularly, the present invention relates to boilers of the type known as gasification boilers which burn wood or biomass or the like to provide energy which heats water.

Wood has long been used as a readily available and relatively cheap source of fuel. Traditionally, wood has been the only real alternative to electricity, oil, and gas. In conventional wood furnaces, after the initial burning of the fuel, a large amount of combustible gas is released. This unburned gas may account for as much as 50 percent of the wood fuel energy, and this amount of energy is unfortunately lost.

A high percentage of this lost energy may be captured and used in a process called gasification. In a gasification boiler, the gases and unburned particles given off when burning (with primary air) the wood or biomass, which otherwise would pass up the flue, are met in a secondary combustion chamber with a jet of superheated air, resulting in a torch-like combustion of these retained gases and particles at very high temperature, such as 1100 degrees F. or more. At lower temperatures, there is thus incomplete combustion with unburned gases and particulates vented up the stack. If the temperature remains above this very high temperature, the torch-like fire consumes generally all of the wood gases and solid materials so as to derive a greater amount of the energy content of the wood or biomass thereby providing more efficient operation, i.e., achieving an overall heating efficiency which may be almost 90 percent (translating to lower wood requirements). Such high temperature secondary stage combustion may result in almost no creosote or ash, thus burning cleanly with little risk of a chimney fire. With virtually no exhaust gases, a wood gasification boiler eases the burden on the environment and greenhouse emissions.

As used herein and in the claims, the term "gasification boiler" is defined as a boiler which utilizes a forced draft air supply (which is meant to include air suction) at each of two or more stages of fuel combustion wherein gases or other fuel particles remaining after a first stage of combustion are burned in a second stage of combustion at a temperature in excess of about 1100 degrees F. to more completely burn the fuel.

Patents which may be of interest to gasification boilers include U.S. Pat. Nos. 4,513,671, 4,531,464, 4,549,526, 4,598,649, 4,635,899, 5,289,787, 5,323,716, 5,338,144, 5,338,918, 5,353,719, 5,361,709, 5,388,535, 5,417,170, 5,420,394, 5,428,205, 5,501,159, 5,586,855, 6,050,204, 6,055,916, 6,176,188, and 6718889, and all of which are incorporated herein by reference. See, relative to gasification or other non-gasification boilers, also the websites of www.alternateheatingsystems.com of Alternate Heating Systems Inc. of Harrisonville, Pa., www.woodboilers.com of Tarm USA Inc. of Lyme, N.H., www.dectra.net of Garn of Minnesota, www.centralboiler.com of Central Boiler, Inc., www.greenwoodfurnace.com, www.rohor.com, and www.eko-vimar.com.pl of Eko-Vimar Orlanski of Poland. Other patents relating to gasification include U.S. Pat. Nos. 4,287,838, 4,388,082, 4,394,132, 4,498,909, 4,601,730, 5,226,927, 5,399,323, 5,551,958, 5,803,936, 6,024,932, 6,802,974, 6,968,678, 7,144,558, and 7,214,252 all of which are also incorporated herein by reference. See also T. Nussbaumer, "Combustion and Co-combustion of Biomass: Fundamentals, Technologies, and Primary measures for Emission Reduction," 17 *Energy & Fuels* 1510-1521, 2003.

Additional patents/published applications which may be of interest to the present invention include U.S. Pat. Nos./published applications U.S. Pat. Nos. 4,444,127; 7,228,806; 2008/0041357; U.S. Pat. No. 7,241,322; 2005/0109603; 2006/0196398; 2007/0187223; U.S. Pat. Nos. 4,028,193; 4,549,526; 2,374,611; 4,917,772; 4,406,619; 1,943,213; 4,280,476; 2,352,057; 25,579; 1,527,153; 1,652,713; 1,821,204; 1,636,537; 2,443,910; 2,444,402; 4,313,418; 4,337,753; 4,494,525; 4,694,817; 6,067,979; 4,047,515; 5,920,168; and 4,226,195, all of which are incorporated herein by reference.

U.S. Pat. No. 4,635,899 discusses a Eshland Enterprises, Inc. gasification boiler as follows:

> Another prior art furnace for burning waste product particle fuel is manufactured by Eshland Enterprises, Inc. of Greencastle, Pa. under the trademark "Wood Gun". Generally referred to as a wood gasification boiler, it has an insulated housing in which an upper, primary particle fuel retention and combustion chamber and a lower, secondary or afterburning combustion chamber are formed by refractory materials. A series of generally vertically extending passageways interconnect the bottom of the upper chamber with the top of the lower chamber. A quantity of waste particle fuel delivered into the upper chamber of the boiler through a fuel inlet in the top of the housing falls toward the bottom of the upper chamber and forms into a pile of fuel particles. The pile of particle fuel is ignited and burns from the bottom adjacent the location of the passageways. Periodically, the pile is replenished by delivery of additional particle fuel through the top fuel inlet of the housing.
>
> Combustible gases generated as by-products from the burning of the particle fuel in the upper, primary chamber, along with air introduced into the upper portion of the primary chamber above the pile of fuel, are drawn downward through the passageways into the lower, secondary chamber by a draft inducing fan which creates a negative pressure drop in the lower chamber relative to the upper chamber. A suitable heat recovery unit is connected to the lower combustion chamber for capturing much of the heat produced by burning the combustible gases therein.

Alternate Heating Systems Inc. manufactures gasification boilers (like the above-described Eshland Enterprises boiler) which have a water jacket between inner and outer walls for transferring heat from the firebox to water for use of the heated water. The outer wall is composed of hot rolled ¼ inch A36 (ASME standard) steel boiler plate, and the inner wall is composed of ¼ inch stainless steel, and the inner and outer walls are connected by hot rolled steel stays welded thereto. Stainless steel undesirably cannot handle the temperature rise and fall as well as A36 steel boiler plate, and creosote (the secretion of moisture and unburned gases in a boiler) attacks stainless steel more than A36 steel boiler plate. When in combination with steel plate, over time stainless steel may undesirably create stress cracks and shorten the life of the boiler.

Greenwood, on its website, states that most wood burning furnaces and wood boilers on the market are unable to sustain a temperature of 1100 degrees F. or higher, that those typical furnaces/boilers are built with a firebox of steel surrounded by a jacket of water, that the water jacket serves to transfer heat from the firebox to the home heating system and to cool the steel firebox and keep it from melting, and that by keeping the firebox cool, the water jacket also cools the fire and prevents it from burning at the temperatures needed for complete combustion.

Greenwood says that the firebox of its hydronic wood furnace is made of super-duty ceramic refractory, cast four to six inches thick, and surrounded by layers of insulation designed to keep the heat in. A natural draft system pulls air into the furnace which fans the flames and creates a roaring fire with sustained temperatures of 1800 to 2000 degrees F. Heat from the fire is captured by a water tube heat exchanger located above the firebox in the path of escaping superheated gases. The furnace extracts heat from these escaping gases, not the fire below. Water thermostats control the operation of the furnace by monitoring the temperature of the heat transfer fluid and regulating a damper on the air intake manifold. At the desired temperature in the house, the damper closes, shutting off the flow of fresh air and extinguishing the fire. When more heat is needed, the damper opens and the furnace re-fires. Heat stored in the refractory walls of the firebox is said to support automatic re-firing for up to 24 hours. Although the superheating may result in some gasification, this Greenwood boiler is not considered to be a gasification boiler (see the above definition of "gasification boiler") because it utilizes a single stage and a natural draft.

Central Boiler has a non-gasification boiler which is claimed to utilize heavy gauge carbon steel or titanium enhanced stainless steel and urethane insulation and utilizes an insulated cast iron door. A baffle is said to trap heat and gases for complete combustion.

The Tarm gasification boiler is said to utilize a firebox with two distinct chambers. In the primary chamber (firebox) the wood charge is ignited. The burning occurs at the bottom of the firebox and the heat from the fire bakes the wood above releasing the wood gas from the fuel. A combustion draft fan then blows these gases through the live coals and into a superheated ceramic tunnel where secondary air is injected to complete the burning process with a 2000 degree flame. Tarm claims that this boiler burns so clean and hot that virtually no visible smoke comes out of the chimney.

Eko-Vimar Orlanski (Eko) markets what it calls a wood gasification boiler which has upper and lower combustion chambers with access doors and supplied with air by a fan. See Eko-Vimar Orlanski, Operating Manual for "Wood Gasification Boiler at 18-80 kW," obtained from the above Eko-Vimar web site in 2007. To control wood quantity, it is recommended by Eko-Vimar Orlanski (page 15 of the above Eko-Vimar Operating Manual) that the boiler be switched off, the chimney flap opened, the upper door opened and the upper chamber loaded as necessary, and the door then closed, the chimney flap closed, and the boiler switched on. To avoid gasification chamber cooling if returning water is too cool, a mixing valve, which mixes hot water with return water, is installed at the boiler's outlet. A regulator is said to modulate the fan's operating, depending on an indicator's indication of the boiler's temperature, and, if a pump is connected to the regulator, it is turned off until the boiler reaches a certain temperature, then stops below that temperature, then again activates when that temperature is again reached. A microprocessor temperature regulator for central heating boiler is designed to control air blow in the boiler and to actuate a circulating pump in central heating system.

The Eko boiler as well as other gasification boilers have turbulators to create resistance to flue gas flow in the lower chamber to effect more efficient burning.

The Eko boiler water jacket walls are composed of 4 mm (0.156 inch) steel plate which undesirably wears out rapidly, reducing the boiler life. The water jacket thereof has a heat exchanger therein, and the water jacket capacity is so small that a water storage tank is required.

The Eko boiler doors are thin and light and have refractory material therein. It is believed that the lower door might have a heat deflector plate to the inside of the refractory material. It is believed that the Eko doors have no insulation between the refractory material and the door outer skin. Eko doors have 18 gage sheet metal to the outside of the door skin with an air gap between the skin and the sheet metal to protect people touching the doors.

The Eko boiler has a pipe built coil in the top of its water jacket which runs fresh water through a cool-down unit in the event of over-heating. Such an over-heat device is considered to be possibly dangerous at the elevated temperature due to thermal shock from cold water hitting and mixing with the boiling water, and the problems that could result include broken pipes, thermal shock to the water jacket, and lowering of the boiler life, if not destroying the boiler.

It is an object of the present invention to provide a durable and rugged and heat retaining and efficient gasification boiler.

It is a further object of the present invention to heat the water evenly throughout the water jacket for less thermal shock and longer boiler life and so that the boiler can come up to temperature faster for greater efficiency.

It is yet another object of the present invention to protect the user from a pressurized wood loading chamber when opening the door to the chamber to load more wood.

The above and other objects, features, and advantages of the present invention will be apparent in the following detailed description of the preferred embodiment thereof when read in conjunction with the appended drawings wherein the same reference numerals denote the same or similar parts throughout the several views.

BRIEF DESCRIPTION OF THE DRAWINGS

FIG. 28 is a partial schematic elevation view of the boiler illustrating the upper chamber refractory and the lower chamber refractory block.

FIG. 29 is a view similar to that of FIG. 28 illustrating the boiler with an alternative embodiment of the upper chamber refractory and an alternative embodiment of the lower chamber refractory block.

FIG. 30 is a side view (rear to forward, as placed in the boiler) of the refractory block of FIG. 29.

FIG. 34 is a schematic view of a thermal storage tank incorporated into the water outlet and inlet of the boiler.

DETAILED DESCRIPTION OF THE PREFERRED EMBODIMENT(S)

Figure 1:
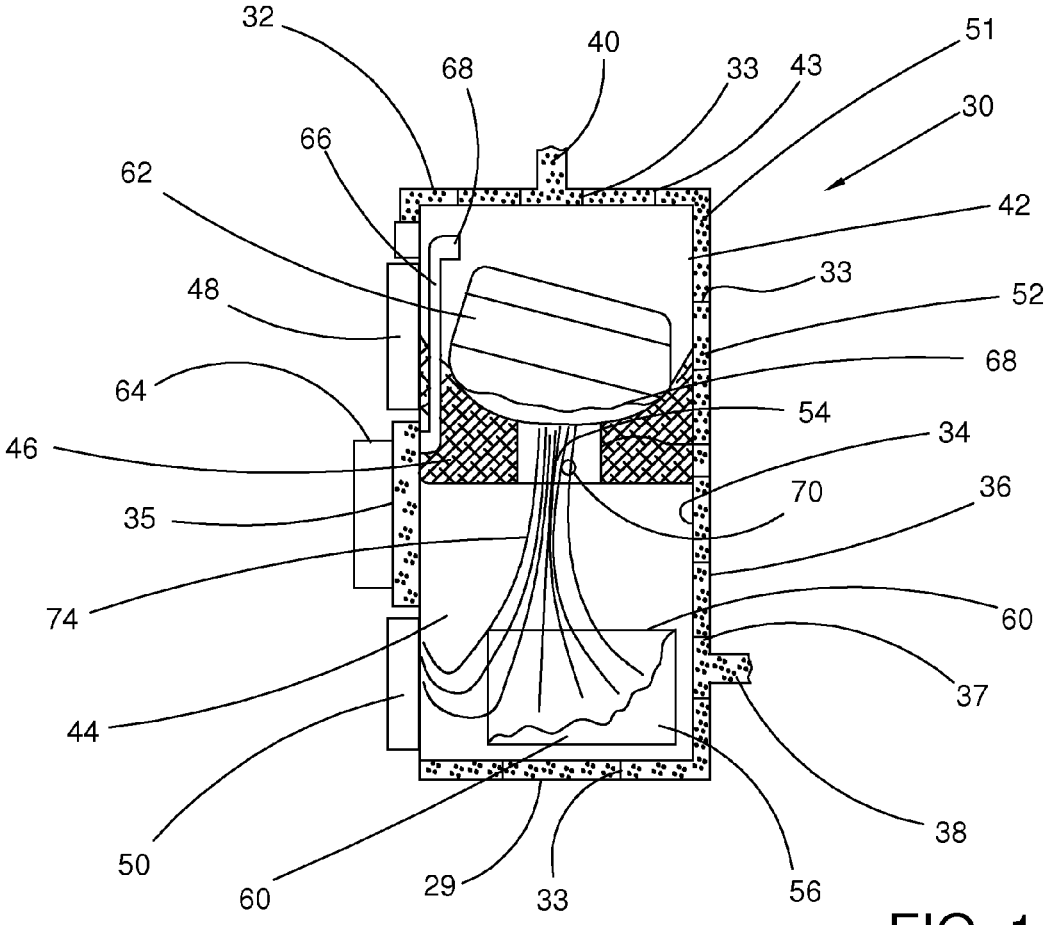
FIG. 1 is a partly sectional diagrammic view of a boiler which embodies the present invention and illustrating the boiler in use.
Figure 2:
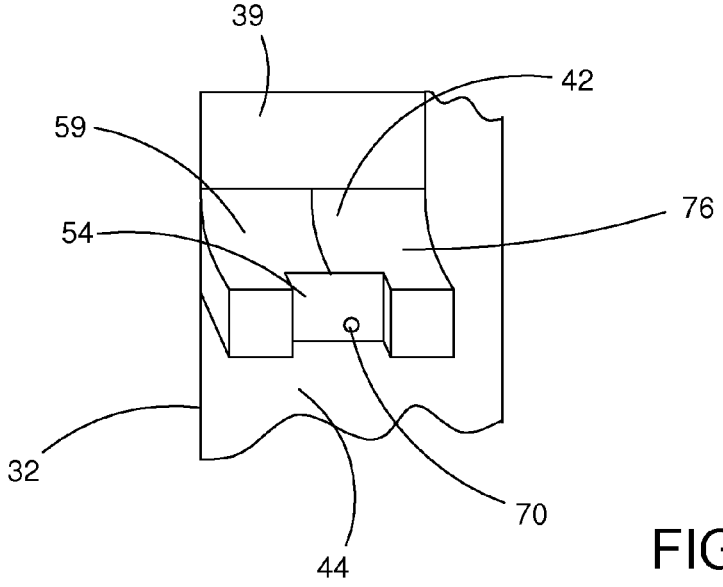
FIG. 2 is a partial perspective view thereof, partly sectional, illustrating the upper chamber refractory therefor.
Figure 3:
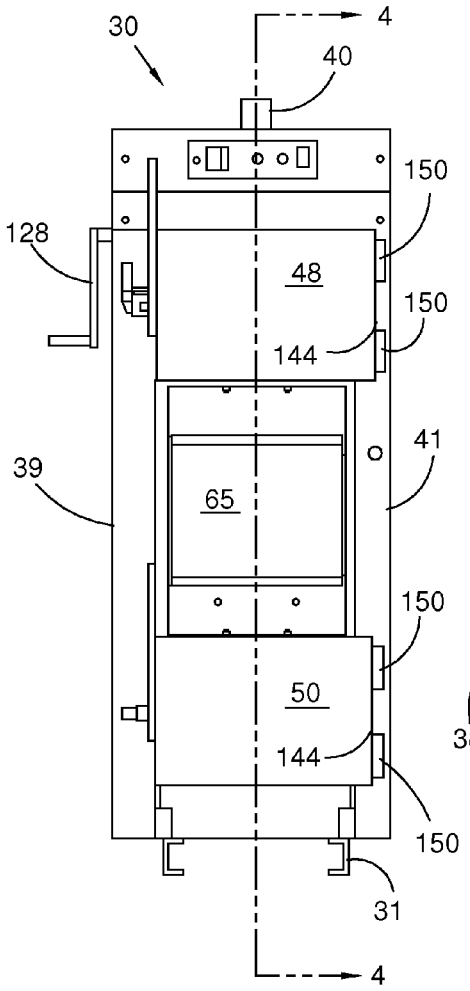
FIG. 3 is a front elevation view thereof.

Referring to FIG. 1, there is illustrated generally at 30 a gasification boiler having a housing or casing 32 (on suitable supports 31) having inner and outer walls 34 and 36 suitably durably connected (as, for example, by welding) by a suitable number of support members or stays 33 (which may be, for example, ⅝ inch diameter steel rod) and between which is contained water (or other suitable fluid), illustrated at 51, to be heated, as described in greater detail hereinafter, to a temperature of, for example, about 170 degrees F. for use by the user in heating his or her home, supplying hot water, and other purposes as desired. These double walls or water jacket 34 and 36 define a floor 29, forward (between upper and lower doors 48 and 50 respectively) and rear walls 35 and 37 respectively, right and left side walls 39 and 41 respectively (FIG. 3), and an upper wall or ceiling 43. The distance between the inner and outer walls 34 and 36 may vary and may be, for example, in the range of about 1½ to 3 inches, providing a high volume water jacket, i.e., for example, a water capacity of 28 gallons for a 100,000 btu unit up to a water capacity of 80 gallons for a 300,000 btu unit, for faster heat-up and greater output. The water inlet (return line) and outlet piping are illustrated at 38 and 40 respectively. The double wall housing or casing can be constructed using principles well known to those of ordinary skill in the art to which the present invention pertains.

The boiler has an upper chamber, illustrated at 42, and a lower chamber, illustrated at 44, separated by a refractory wall 46 which is also known herein as the upper chamber refractory. Upper and lower doors 48 and 50 provide access to the upper and lower chambers 42 and 44 respectively (which define the firebox). The front-opening lower door 50 provides easy occasional maintenance by providing easy access for occasional cleaning of any ash from the secondary chamber. Sheet metal skins, illustrated at 49, are installed about the boiler in accordance with principles commonly known to those of ordinary skill in the art to which the present invention pertains, the panel flange 410 provided to stabilize left and right back skin panels, and water jacket standoffs, illustrated at 416 in FIG. 6, welded or otherwise suitably attached to the outer water jacket wall 36, for attachment of the skins 49 with sheet metal screws or other suitable fasteners.

Figure 13:
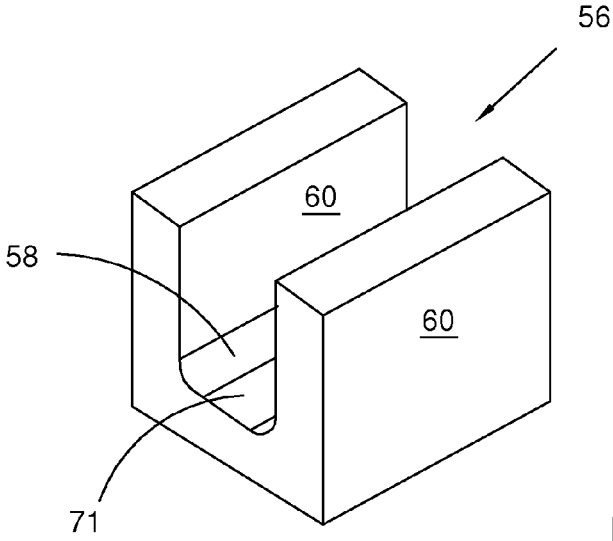
FIG. 13 is a perspective view of a refractory block for the lower chamber.
Figure 14:
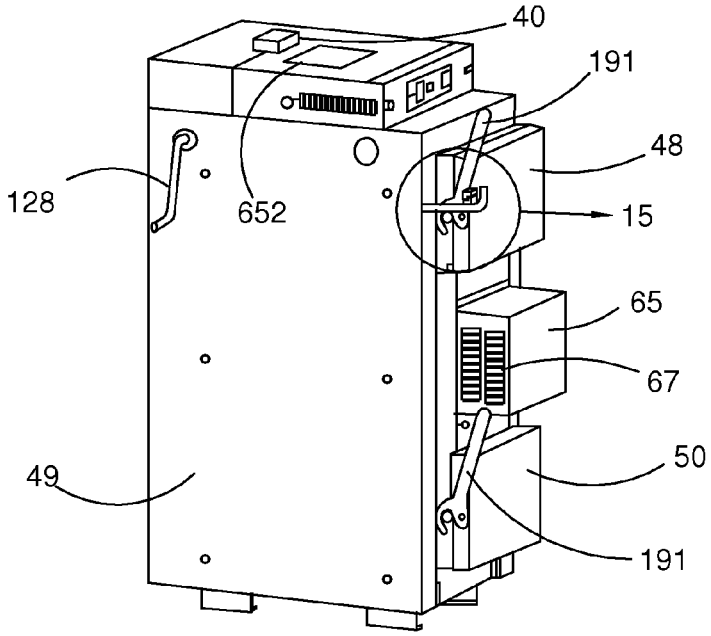
FIG. 14 is a perspective view of the boiler illustrating the upper and lower chamber doors in closed positions.

The refractory wall 46 is shown to have a central opening, illustrated at 54, which may be, for example, rectangular in shape, extending vertically entirely through the refractory wall 46 thus providing flow communication between the upper and lower chambers 42 and 44 respectively. The refractory wall 46 is also shown to have a curved wall portion, illustrated at 57, sloping upwardly from the central opening 54 to the left side wall 39 of the housing 32 and has a similar curved sloping wall portion 57 sloping upwardly from the central opening 54 to the right side wall 41 of the housing 32. A generally U-shaped refractory member 56 (see FIGS. 13 and 28), a portion of one of its walls torn away in FIG. 1 for purposes of clarity of illustration, having a horizontal open end passage, illustrated at 58, between its vertical walls 60, is received on the floor 29 with one end adjacent or against the rear wall 37 thereby to block passage of combustion gases through its open rear end.

During operation of the boiler 30, the upper chamber 42, as discussed hereinafter, is pressurized since the only exit for combustion gases is downwardly through the narrow opening 54. A damper or blast plate 55 (FIG. 16) is provided in the upper portion of the rear wall 37, as hereinafter discussed, to relieve the pressure when the upper chamber door is opened to, for example, load additional wood 62. Accordingly, in accordance with the present invention, the refractory structure 46 extends entirely across (i.e., over entirely 360 degrees horizontally) and sealingly engages the inner casing 34 in a manner to seal the upper combustion chamber 42 from the lower combustion chamber 44 so that the upper combustion chamber 42 can be made substantially air tight (it being understood that the "sealing" and "air tightness" is with the exception of the passage 54 to the lower combustion chamber 44 for the pressurized expulsion of combustion gases and particulates therethrough). Thus, the upper combustion chamber 42 is sealed to provide air tightness (at least substantially) by the refractory structure 46 and by the closing of the damper 55 and upper refractory chamber door 48, with the result that the combustion products are forced by the forced draft through the narrow central opening 54 at high speed. It is also to be understood that the opening 54 passes through the nozzle member 76 and the underlying refractory material, as discussed hereinafter.

Figure 7:
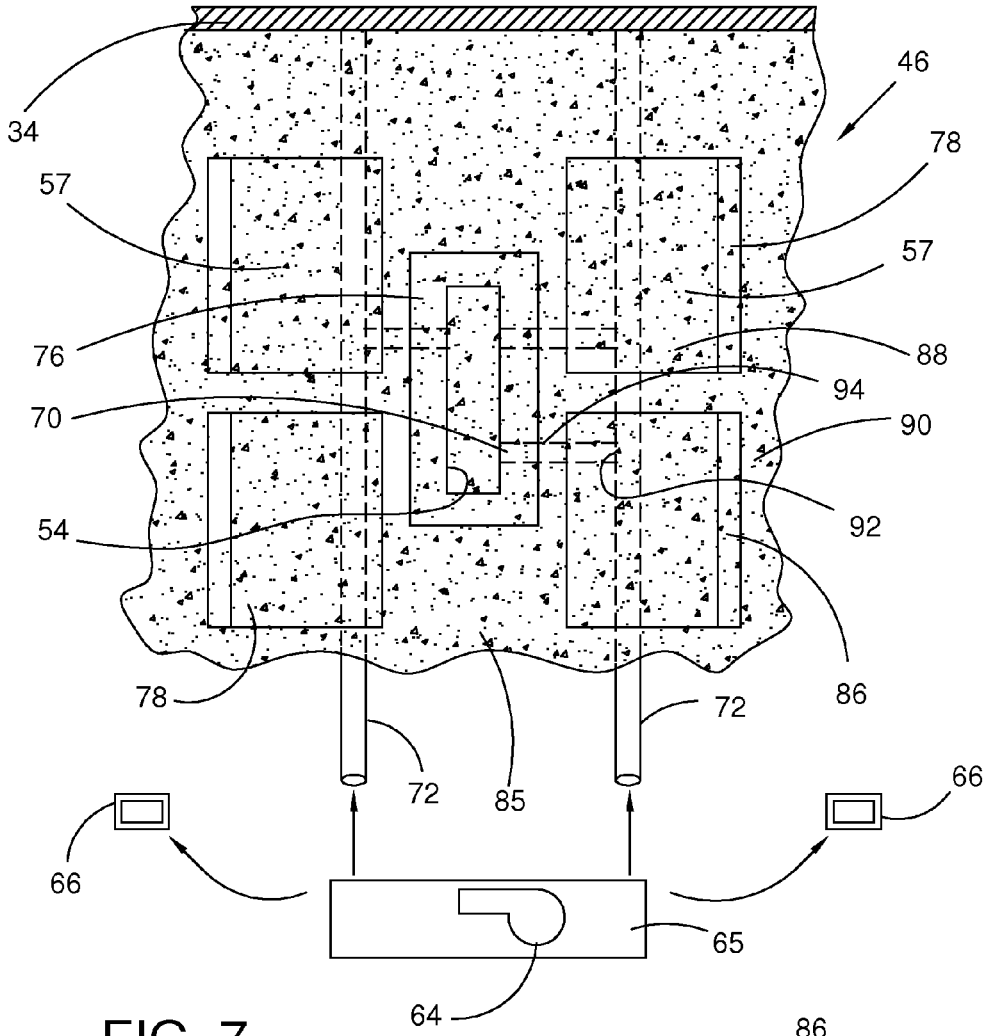
FIG. 7 is a diagrammic plan view of the upper chamber refractory and associated air passages.
Figure 8:
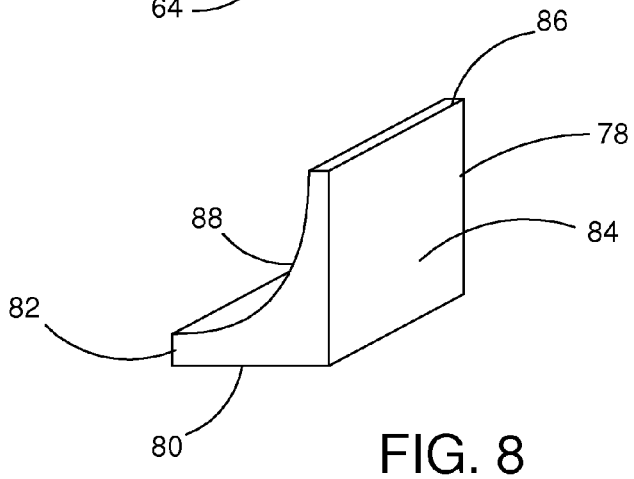
FIG. 8 is a perspective view of a refractory block for the upper chamber refractory.
Figure 10:
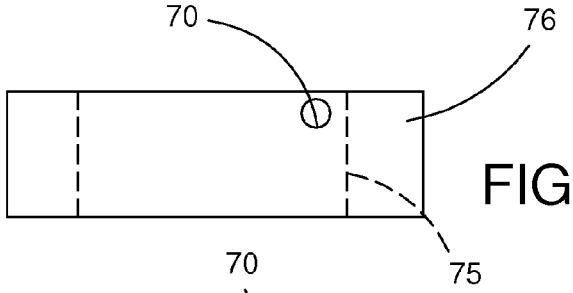
FIG. 10 is a side view of the nozzle member.
Figure 12:
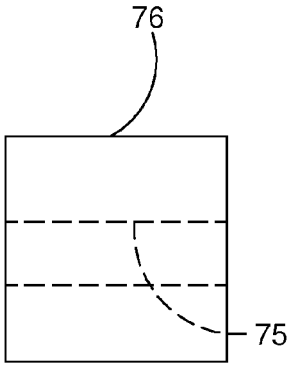
FIG. 12 is an end view of the nozzle member.

Operation of the boiler starts (with the damper 55 closed) with loading the upper chamber 42 with fuel in the form of logs 62 or other suitable wood or biomass, the logs being laid on top of the refractory wall 46, and having water 51 circulating in the water space 52 between the inner and outer walls 34 and 36 respectively. With the doors 48 and 50 closed, primary air is supplied by a forced draft fan 64 (within housing 65 having air inlet openings 73) through vertical conduits 66 (FIGS. 4 and 7 as well as FIG. 1) and is discharged at conduit outlets 68 in the upper part of the upper chamber 42. Alternatively, a suction blower could be used to effect a draft or air flow by suction. The primary air supplies oxygen for burning the wood 62 in the upper chamber 42. The burning of the wood 62 is initiated in any suitable manner such as manually, for example, by the use of newspapers and the application of a lighted match thereto. The chamber 42 is suitably constructed to be, with the damper 55 and upper chamber door 48 closed and with the exception of the central opening 54, a closed chamber, allowing escape of the combustion products, illustrated at 68, only downwardly through the narrow central opening or nozzle 54 at high speed. Heat from the primary combustion in the upper chamber 42 is given up to the inner wall 34 along the upper chamber 42 to heat the water 51 between the inner and outer walls 34 and 36 respectively surrounding the upper chamber 42.

As the unburned gases and other combustion products flow downwardly through the central opening 54, they are supplied by the forced draft fan 64 with secondary air via tubes 72 to outlets, illustrated at 70, in the central opening 54, as more specifically discussed hereinafter. Once the refractory 46 reaches a temperature in excess of about 1100 degrees F., for example, in the 1400 to 1500 degrees F. range, it ignites the oxygen in the secondary air along with the unburned gases/solids from the burning of the wood 62 thereby "gasifying" the combustion products to efficiently extract a very high percentage of the wood heat content. The resulting gasified material, illustrated at 74, flows downwardly at high speed between the walls 60 and impinging on the floor 71 of the refractory member 56. The refractory member 56 is U-shaped (or otherwise suitably shaped, as discussed hereinafter with respect to FIGS. 29 and 30) to channel the flame and heat to stay awhile in the lower chamber 44, burning more unburned gases (the hotter it gets, the more unburned gases/particulate is burned) for even cleaner and more combustion efficient burning—so that very little particulate or gases remain to be released from the boiler 30. The heat/gases flow forwardly (toward the front of the boiler) from the passage 58 and upwardly, giving up heat to the water 51 in the lower chamber 44 all along the surfaces of the inner wall 34, then whatever waste/gases/particulate remains is released from the boiler 30 as will be discussed in greater detail hereinafter.

It is now considered that the optimum percentage of moisture for wood gasification is about 15% to 23%. A long burn cycle of up to 8 to 10 hours translates to less hassle and more comfort.

Referring to FIGS. 7, 8 to 12, and 28, the upper chamber refractory wall 46 includes a centrally disposed refractory nozzle member or block 76 (or more) containing an opening 75 which is part of the opening or nozzle 54 extending vertically entirely through the refractory wall 46. The nozzle block 76 is surrounded by four (or other suitable number) of refractory blocks 78 each having a bottom wall 80, a short inner wall 82 extending vertically upwardly from the inner end of the bottom wall 80, a vertical side wall 84, a short upper wall 86 extending horizontally inwardly from the upper end of the bottom wall, and a curvilinear wall 88 sloping upwardly and outwardly from the upper end of wall 82 to the inner end of wall 86 thereby defining the sloping wall portions 56 and 57 which may be said to form a forwardly and rearwardly extending trough upon which the wood 62 is placed. Refractory material, illustrated at 90, is molded in situ in and among refractory blocks 76 and 78 and extending sealingly to the inner wall 34 on all sides to define the refractory wall 46 sealingly separating (with the exception of the nozzle 54 for passage downwardly of primary combustion products) the upper and lower chambers 42 and 44 respectively and defining the aforementioned trough. The refractory wall 46 is formed in situ as below described.

The secondary air tubes 72 are welded or otherwise suitably attached to the inner wall 34 at the rear of the boiler 30, and they extend through the inner and outer walls 34 and 36 at the front of the boiler 30 where they are suitably connected for flow communication with the blower 64 in accordance with principles commonly known to those of ordinary skill in the art to which the present invention pertains.

A section of plywood (not shown) is supported at the desired level, illustrated at 77 in FIG. 28, of the under surface of the refractory wall 46. The plywood is provided with a central depression therein in which is placed a plastic insert to provide the downward gas passage portion, illustrated at 79, from the bottom of the nozzle member 76 into the lower chamber 44 when the refractory mortar material is laid and cured. A layer 81 of refractory mortar (for example, about 3 inches thick) is poured or laid onto the plywood and around the plastic insert to just under the secondary air tubes 72 and allowed to cure (for example, about 3 days), then the plywood and insert removed, leaving the vertical passage 79 for alignment of the nozzle 75 therewith to complete the passage 54 entirely through the refractory structure 46. To obtain a good bond with the inner wall 34 all the way around, rebar-like members may be welded to the inner wall 34 to extend into the mortar or other suitable means may be employed in accordance with principles commonly known to those of ordinary skill in the art to which the present invention pertains.

After the bottom refractory layer 81 is cured, the nozzle member 76 is placed in position with the nozzle 75 aligned with the passage 79 formed in the bottom refractory layer 81, and plastic tubes positioned each with one end inserted in a secondary air inlet aperture or passage 70 in the nozzle block 76 and the other end inserted in a corresponding aperture, illustrated at 92, in the wall of a corresponding tube 72 to form an air passage, illustrated at 94, therebetween when a second layer of refractory, illustrated at 83, is poured or laid and cured. The second layer 83 of refractory mortar (for example, about 3 inches thick) is then poured onto the cured first layer 81 and around the nozzle block 76 and covering the tubes 72 and inserts for passages 94 up to a level about one inch below the top of the nozzle block 76 and allowed to cure (for example, about 3 days), and this layer 83 may also be suitably bonded/attached to the boiler inner wall 34 similarly as described above for the first layer 81. The plastic tube inserts for passages 94 burn out when the boiler 30 is first fired.

The L-shaped refractory members 78 are then placed in position and a third layer 85 (FIG. 7) of refractory mortar is poured or laid up to the top of the nozzle block 76 and additional refractory mortar troweled in to form the desired final form of the upper surface of the refractory wall 46 and allowed to cure (for example, about 3 days). If needed due to space limitations, the L-shaped blocks 78 may be suitably notched to fit with or accommodate the nozzle block 76. Again, as needed or desired, this layer 85 may also be suitably bonded/attached to the boiler inner wall 34 similarly as described above for the first layer.

Figure 9:
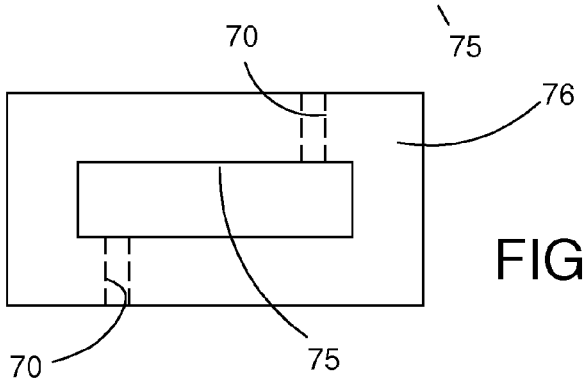
FIG. 9 is a plan view of a refractory nozzle member for the upper chamber refractory.
Figure 11:
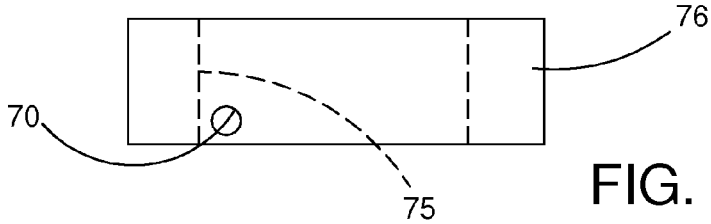
FIG. 11 is the other side view of the nozzle member.

Depending on the boiler size and requirements, the refractory wall 46 may contain more than one nozzle block 76, and a nozzle block may contain more than one air inlet passage 70 on each side. Preferably, the air inlet passages 70 are offset, as seen in FIG. 9, to reduce interference of air passage with each other and provide a more even flow of secondary air into the nozzle.

The refractory blocks 56, 76, and 78 and the refractory material 90 may (but need not) have the same composition, which is as described below.

In accordance with the present invention, the refractory material (56, 76, 78, and 90) is preferably of a type which retains heat to a temperature in excess of about 2100 degrees F. in order to achieve the desired efficient secondary combustion. Moreover, the refractory material preferably also retains heat for a long time (several hours, for example, 12 hours or more) so that, for example, one can cease using the boiler 30 in the morning and the refractory material will still be hot enough at night to self-ignite when some wood 62 is loaded to re-start the boiler 30. The refractory material is also desirably one that doesn't break down in water and disintegrate, doesn't have to be replaced often, and has a high alumina content for insulating capability, strength, and heat retention. As used herein and in the claims, the term "refractory" refers to a material, whether lining or otherwise contained within the firebox space of a furnace, which is resistant to the heat encountered therein. A suitable refractory material (56, 76, 78, and 90) has been found to be one known as Matripump 60 sold by Matrix Refractories, a division of Allied Mineral Products, Inc. of Columbus, Ohio (www.alliedmatrix.com and www.alliedmineral.com). Such a refractory material is claimed to have as major components 62.0 percent aluminum oxide (alumina), 32.8 percent silicon dioxide, 2.0 percent calcium oxide, and 1.0 percent iron oxide, is said to contain aluminum oxide, calcium aluminate cement, aluminum silicates, and silica, is indicated to have a maximum use temperature of 3100 degrees F., is indicated to have the further benefits of outstanding thermal shock properties and excellent abrasion resistance, and tolerates a wide water range (for molding purposes) without sacrificing physical properties.

Figure 4:
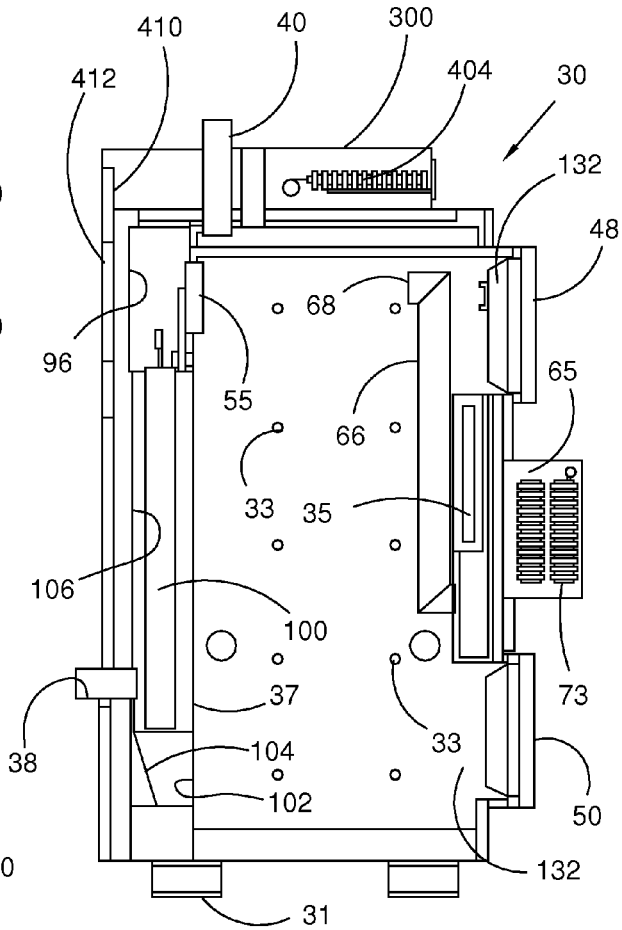
FIG. 4 is a sectional view thereof, less the refractory, taken along lines 4-4 of FIG. 3.
Figure 6:
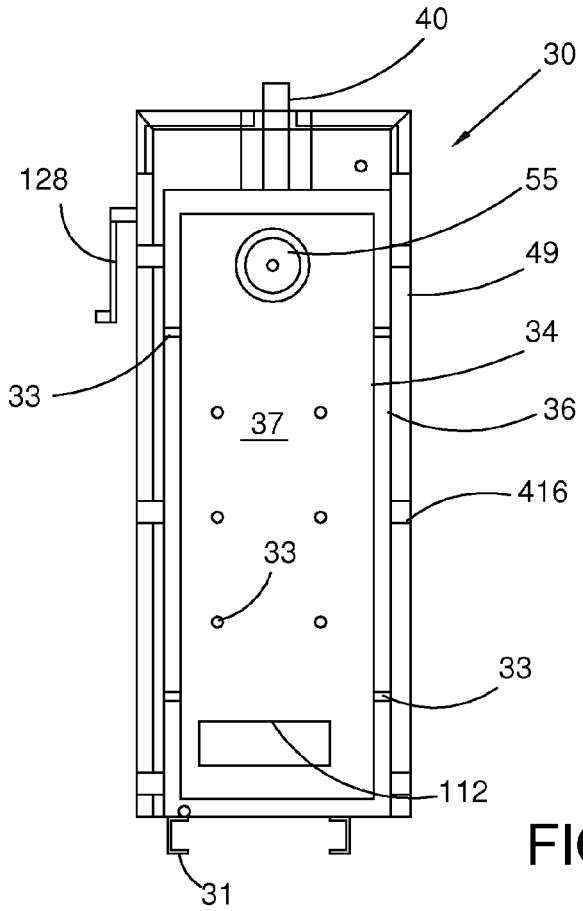
FIG. 6 is a sectional view thereof, less the refractory, taken along lines 6-6 of FIG. 5.
Figure 5:
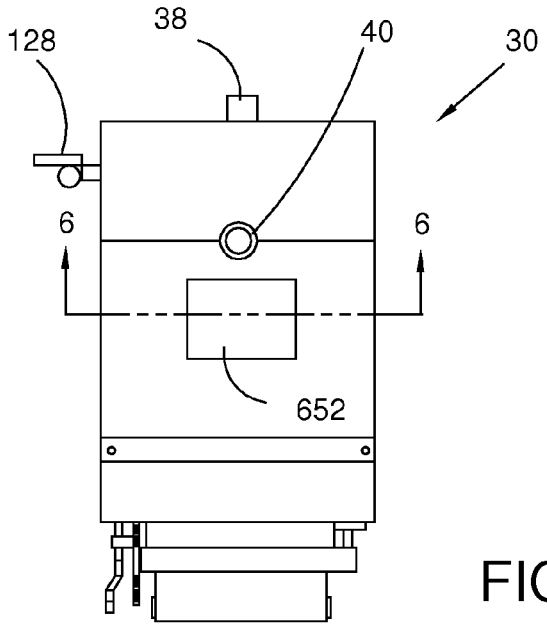
FIG. 5 is an upper or plan view thereof.
Figure 16:
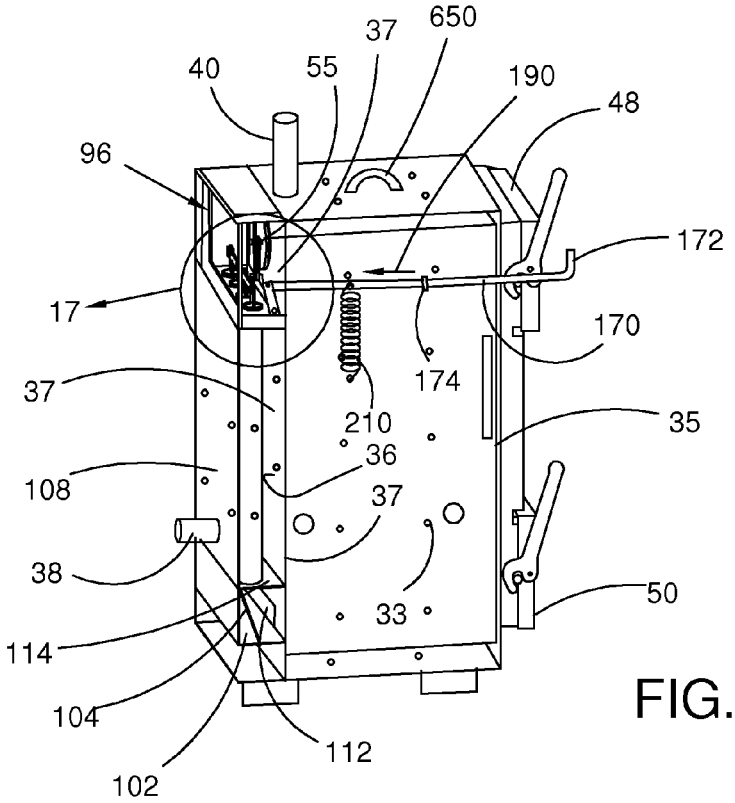
FIG. 16 is a perspective view of the boiler with outer skins removed to illustrate the gas exhaust mechanism.
Figure 17:
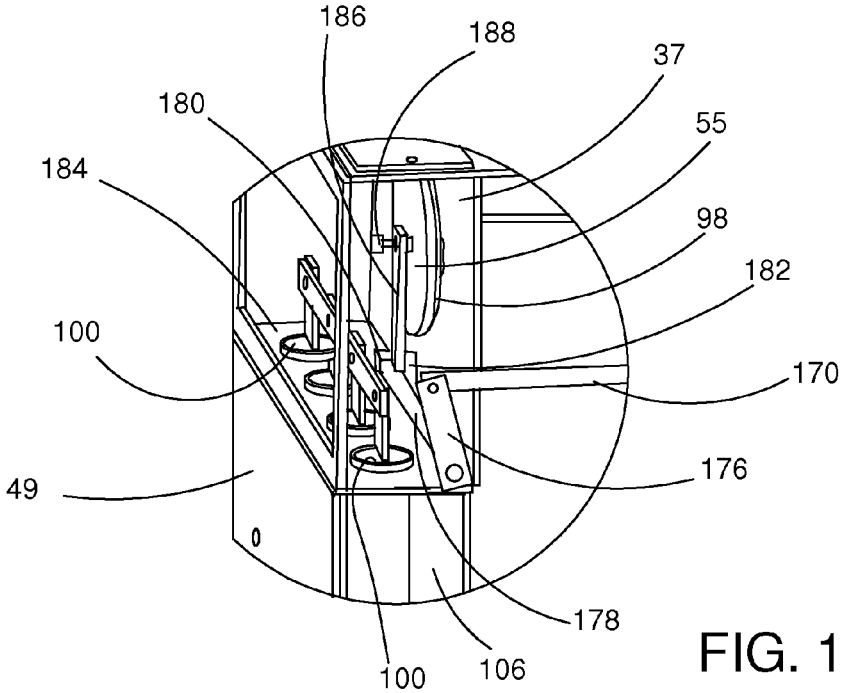
FIG. 17 is an enlarged partial view of the gas exhaust mechanism.
Figure 18:
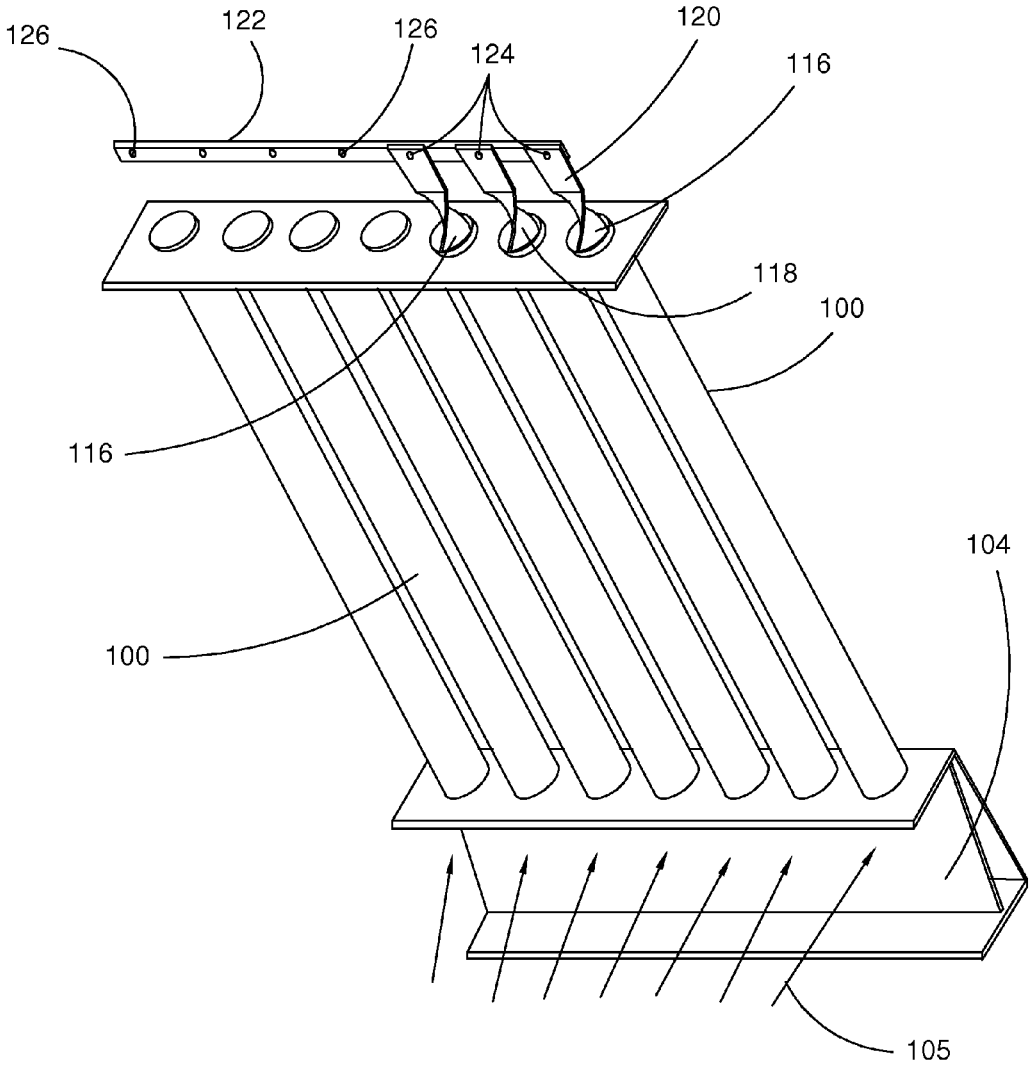
FIG. 18 is an enlarged perspective view of a tube bundle of the gas exhaust mechanism.
Figure 19:
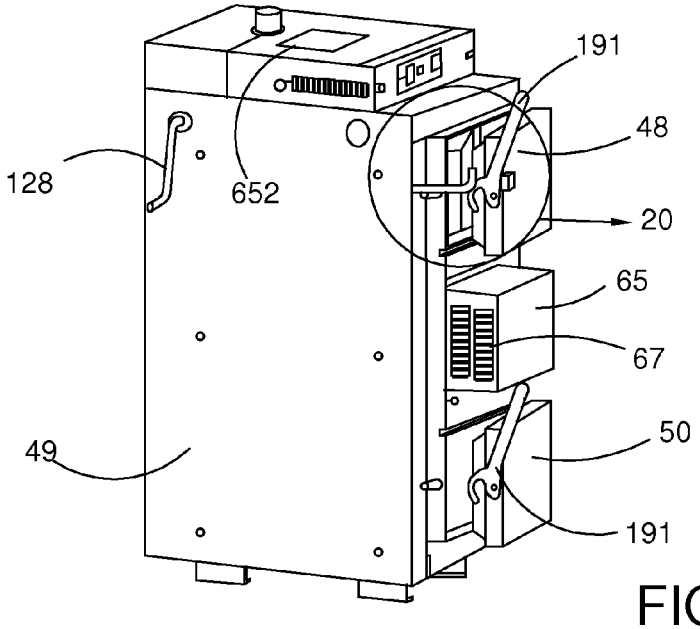
FIG. 19 is a view similar to that of FIG. 14 illustrating the upper and lower chamber doors partially open.

Referring to FIGS. 16 to 18, the waste products of combustion pass from the lower chamber 44 pass through an opening, illustrated at 112 in FIGS. 6 and 16, in the rear wall 37 and into a plenum chamber 102 containing flow-directing baffle(s) 104. These waste products then are directed, as illustrated at 105 in FIG. 18, from opening 112 to and pass into and flow upwardly through a bank of vertical tubes 100 which are welded or otherwise suitable connected to an upper plate 114 of the chamber 102 in flow communication therewith. After leaving the upper ends of the tubes, these waste products pass into an upper plenum chamber 96 (FIG. 4—outer plates of the plenum chamber 96 removed in FIGS. 16 and 17 for ease of illustration). Waste products passing through the damper opening 98 when the damper 55 is open also pass into plenum chamber 96. The waste products from the tubes 100 and from the damper opening 98 pass out of the boiler 30 through a stack or exhaust pipe, illustrated at 412. The bank of vertical tubes 100 are received within a chamber 106 defined as between the outer 36 of the double walls and an outer wall 108. The gases/particulate matter pass upwardly in chamber 106, as best seen in FIG. 4, and out exhaust pipe 412.

In order to restrict the flow of the waste products through the tubes 100 so as to create back pressure so that the products linger longer in the lower combustion chamber 44 thereby more efficiently giving up their heat to the water 51, in accordance with the present invention, an elongate flow restrictor or turbulator 116 is provided in each of the tubes 100 to extend along the length thereof. Each turbulator 116 is formed in the shape of a spiral blade 118 (continuing the pattern as seen at the top of FIG. 18) the upper end of which ends in a generally flat portion 120. The turbulators 116 may be otherwise suitably shaped to suitably restrict flow. A horizontal bar 122 is suitably connected, as by bolts 124 received in holes 126 in the bar 122 and corresponding holes in the portions 120 and secured by nuts (not shown), or otherwise suitably connects the turbulator portions 120.

Figure 27:
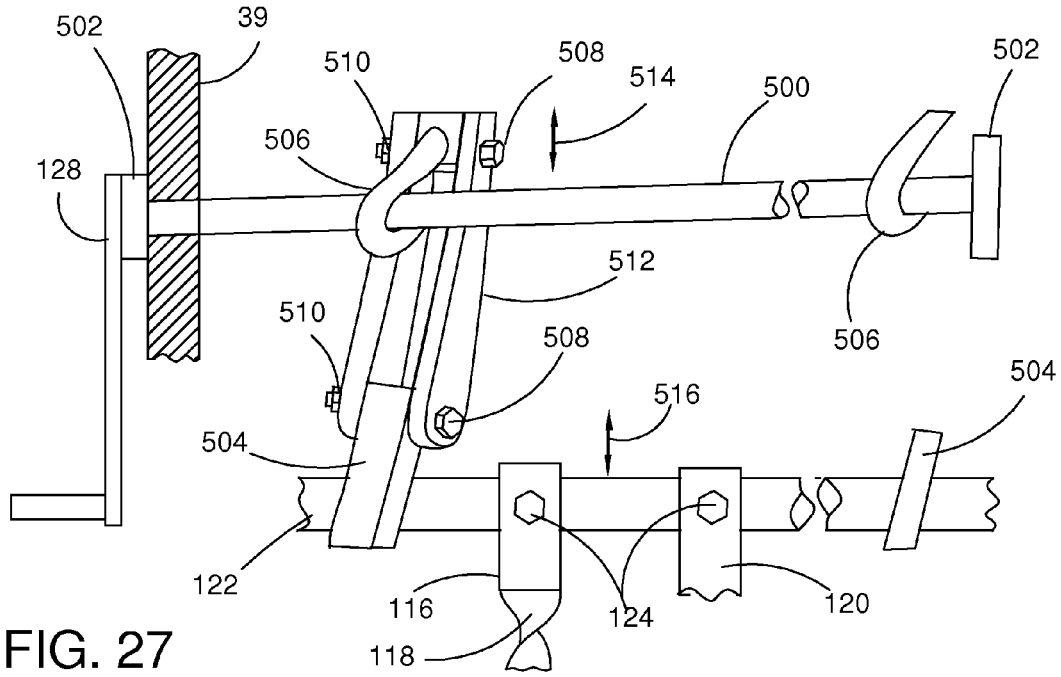
FIG. 27 is a generally diagrammatic view illustrating the connection of a crank to the tube bundle of FIG. 18 for raising and lowering thereof.

Referring to FIG. 27, each end of the bar 122 is suitably connected to a crank 128, as discussed hereinafter, for periodically (for example, twice daily) translating the turbulators 116 up and down for cleaning, i.e., to prevent solids build-up on the tubes 100. The crank 128 is suitably fixedly connected to an elongate member 500 which is suitably rotatably mounted at its ends within bores of bearing members 502. Brackets 504 are fixedly attached to opposite end portions of bar 122, and corresponding brackets 506 are fixedly attached to rotatable member 500. A yoke 512 (only one shown) is pivotly connected at its ends to corresponding brackets 504 and 506 respectively by suitable means such as for example, a bolt 508 and 510 received in a bushing (not shown). Thus, rotational movement of the crank 128 and the corresponding rotational movement of the rotatable member 500 effects up and down movement, illustrated at 514, of the yokes 512 which in turn effect up and down movement, illustrated at 516, of the turbulator bar 122 and accordingly the turbulators 116.

A typical gasification boiler may have 4 mm (0.156 inch) boiler plate or a combination of stainless steel (for the inner water jacket wall) and boiler plate (for the outer water jacket wall). 0.156 inch boiler plate doesn't last very long (perhaps only as much as about 5 to 6 years) due to acidity eating through, and stainless steel and boiler plate steel expand and contract at different rates resulting in break-down stress-wise, as discussed more specifically hereinbefore. In order to provide the boiler 30 to be long lasting, in accordance with the present invention, the inner and outer firebox walls 34 and 36 are each composed of boiler plate (for example, A36 hot rolled steel plate) having a thickness, illustrated at 130 in FIG. 25, of about ¼ inch (or greater), connected by welding with ⅝ inch diameter hot rolled steel stays. Seams are desirably double welded for strength and durability for excellent temperature and corrosion resistance.

In a conventional boiler, doors may have to be replaced often (perhaps about every 2 years), and substantial heat may be lost through the doors. Referring to FIGS. 21 to 24, upper door 48 is provided with a refractory block 132 (not shown in FIGS. 21 and 22), and lower door 50 is similarly provided with a similar refractory block, and thus the description for the door 48 will apply also to the door 50. The refractory block 132 is provided to absorb heat so that the door 48 may be protected from the intense firebox heat and accordingly need not have to be replaced often and (especially for the lower door 50) to provide further heat-retaining refractory for aiding in combustion.

The door 48 includes an outer skin 134 formed of, for example, 10 gauge steel plate, bent at about 90 degrees inwardly along three sides to form upper and lower flanges 136 and 138 respectively and a left side flange 140 which are welded together along their adjoining edges. The flange 140 has a centrally located aperture, illustrated at 142, adjacent its outer edge whose purpose will be described hereinafter. A 90-degree angle iron 144 extends along the right edge of the skin 134 with one flange 146 suitably welded thereto and the other flange 148 extending inwardly from the laterally inner end thereof, as soon in FIG. 23. The angle iron 144 is suitably hingedly connected as by hinges 150 (FIG. 3) to the boiler front wall to allow opening and closing of the door 48.

A plurality of, for example, 4 steel spacers or short rods or studs 152 are suitably welded to the inner surface of the skin 134 to extend inwardly therefrom and are generally evenly spaced. A flat or planar plate 154, which may for example be a 10 or 12 gauge steel plate, is positioned to lie on the spacers 152 between the flanges 136, 138, 140, and 148 and may be suitably welded thereto and is welded to the respective ends of the spacers 152.

A pair of spaced laterally spaced centrally positioned spacers or rods or studs 162 are suitably welded to the inner surface of the plate 154 to extend normal thereto and inwardly therefrom for purposes which will be described hereinafter.

The refractory block 132 is suitably molded situ on the plate 154 (but may alternatively be pre-molded) and extends inwardly from and normal to the plate 154 for a short distance, as illustrated at 156, then is bent to be tapered laterally inwardly at a taper, illustrated at 158, of, for example, about 30 degrees. Along each of the edges (but spaced therefrom for reasons described hereinafter) of the plate 154 is welded or otherwise suitably attached (prior to the pouring and molding of the refractory block 132) a suitably sized and shaped refractory holding plate 160, which may, for example, be 10 gauge steel, which extends inwardly from and normal to the plate 154 for a short distance to engage the refractory block 132 then tapers at the angle 158 so that the four plates 160 will hold the thereafter poured and molded refractory block 132 in place.

Figure 20:
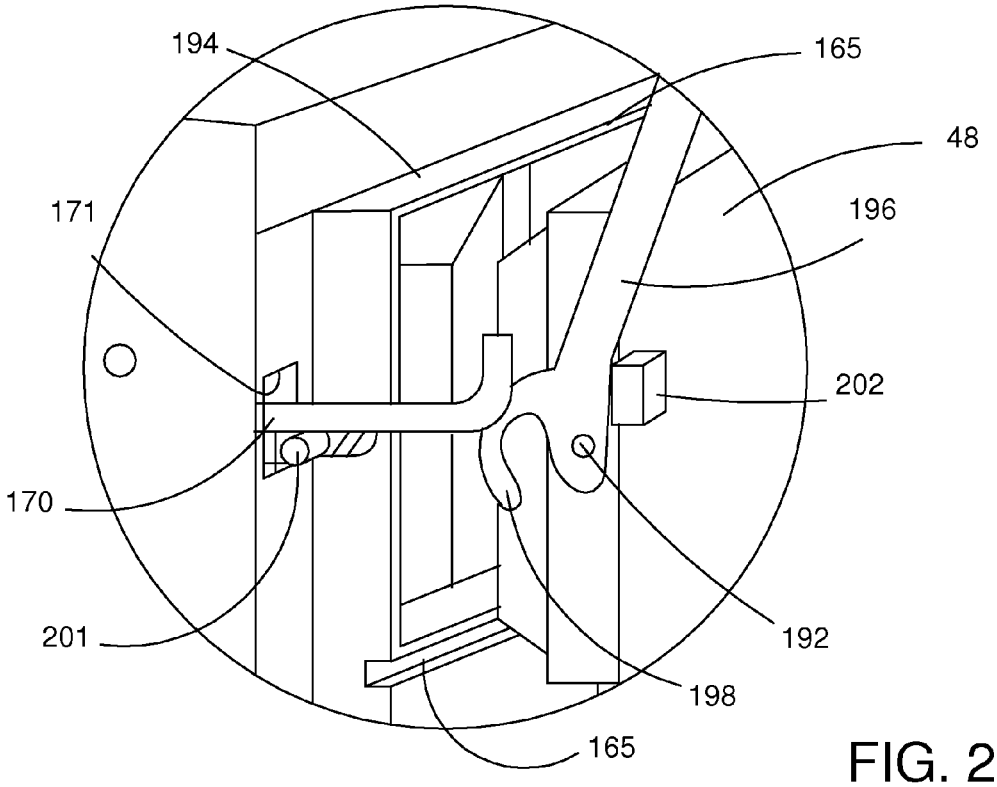
FIG. 20 is a view similar to that of FIG. 15 illustrating the upper chamber door partially open.
Figure 21:
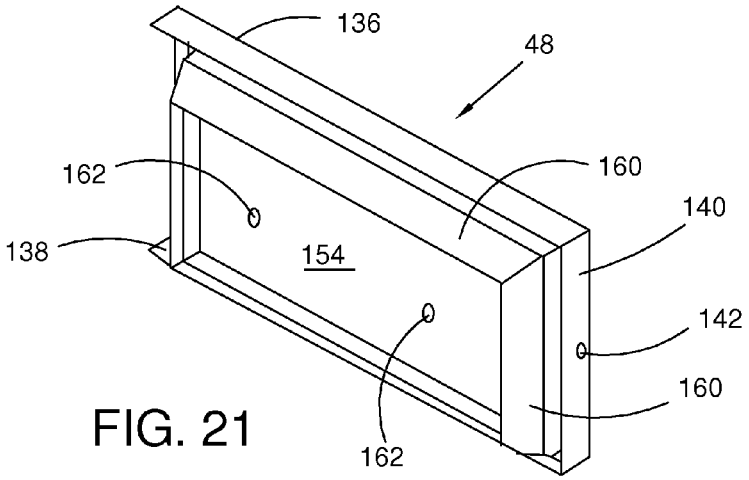
FIG. 21 is a perspective view of the upper chamber door before loaded with refractory, the lower chamber door being similar thereto.
Figure 22:
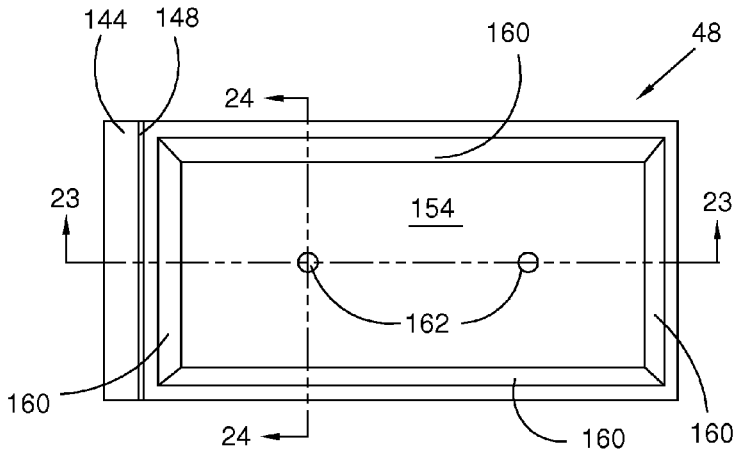
FIG. 22 is a plan or inside elevation view of the door.
Figure 23:
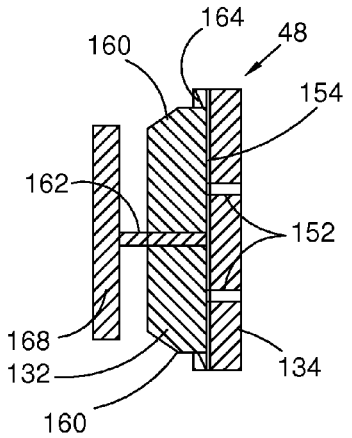
FIG. 23 is a sectional view thereof taken along lines 23-23 of FIG. 22 and showing the door loaded with refractory.
Figure 24:
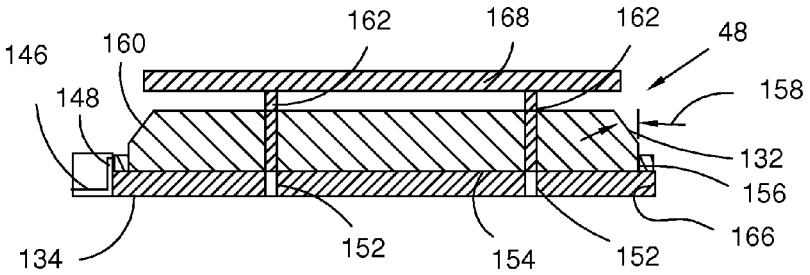
FIG. 24 is a sectional view thereof taken along lines 24-24 of FIG. 22 and showing the door loaded with refractory.

A gasket seal 164 for suitably sealingly engaging a respective edge, illustrated at 165 in FIG. 20, of the opening in the front wall for providing a seal when the door 48 is closed is provided in the gap between each of the refractory holding plate portions 156 and the respective one of the flanges 136, 138, 140, and 148, all of which extend inwardly beyond the plate 154 to house the gasket 164. Alternatively, a single gasket may be provided to extend all the way around the door 48. The gasket 164 may, for example, be a ¾ inch square section of ceramic fiber.

In order to reduce heat transfer from the refractory block 132 to the door outer skin 134 to thereby prevent the door 48 from becoming too hot to touch and to prevent or reduce the loss of heat through the skin 134, in accordance with the present invention, suitable insulation material 166 is packed in the space between the plate 154 and the skin 134 (prior to the installation of the plate 154). The insulation material 166 may, for example, be of a type sold by Smock & Shonthayler of Erie, Pa.

The spacers 162 are sized to have a length to extend beyond the refractory block 132. A planar or flat heat deflector plate or heat shield 168 is welded to the inner ends of the spacers 162 to deflect heat back into the firebox. The deflector plate 168 may, for example, be ¼ inch thick steel. The deflector plate 168 and spacers 162 may, if desired, not be provided for the upper door 48 where the heat is less intense.

Referring to FIGS. 16 and 17, a rod 170 is provided for opening the damper 55 for relieving pressure in the primary or upper chamber 42 so that the door 48 can be safely opened for loading additional wood 62 therein. The rod 170 extends horizontally between the front and rear of the boiler 30 adjacent the outer wall 36 and inside the outer skin on the left side and extends through a suitable opening, illustrated at 171 (FIG. 15), in the forward boiler skin and is screw-fitted at its front end with a handle 172. The rod 170 is pushed inwardly for opening the damper 55 and pulled outwardly for closing the damper 55. The rod is slidingly held in position by a U-bolt 174 or other suitable fastener welded or otherwise suitably attached to the outer wall 36 and positioned closer to the boiler front wall 35 than to the rear wall 37. At its rear end, the rod is suitably pivotly attached to one end of a bracket 176. The other end of the bracket is suitably attached to one end of a laterally extending rod 178 to thereby effect rotation of the rod 178. The other end of the rod 178 is suitably rotatably received in an aperture, illustrated at 180, of a bracket 182 which is welded or otherwise suitably attached to the upper wall 184 of the turbulator housing and/or the rear outer wall 36. One end of an elongate bracket 186 is welded or otherwise suitably rigidly attached to the rod 178 to extend generally vertically therefrom. The other end of the bracket 186 is suitably attached such as by a screw 188 to the circular damper 55 centrally thereof. Thus, by pushing inwardly on the rod 170, as indicated at 190, the bracket 176 is caused to effect rotation of the rod 178 counterclockwise to effect movement of the upper end of the bracket 186 rearwardly thereby pulling the damper 55 away from the exhaust opening 98 thereby opening the damper 55 so that pressure in the upper chamber 42 can be relieved through the damper opening 98. By pulling forwardly on the rod 170, the damper 55 is caused to move forwardly and sealingly close the opening 98 (by the reverse of what is described above for opening the damper 55) so that the boiler can be suitably operated with the upper chamber 42 pressurized, the interface between the damper 55 and the opening 98 being suitably sealed in accordance with principles commonly known to those of ordinary skill in the art to which the present invention pertains.

Figure 15:
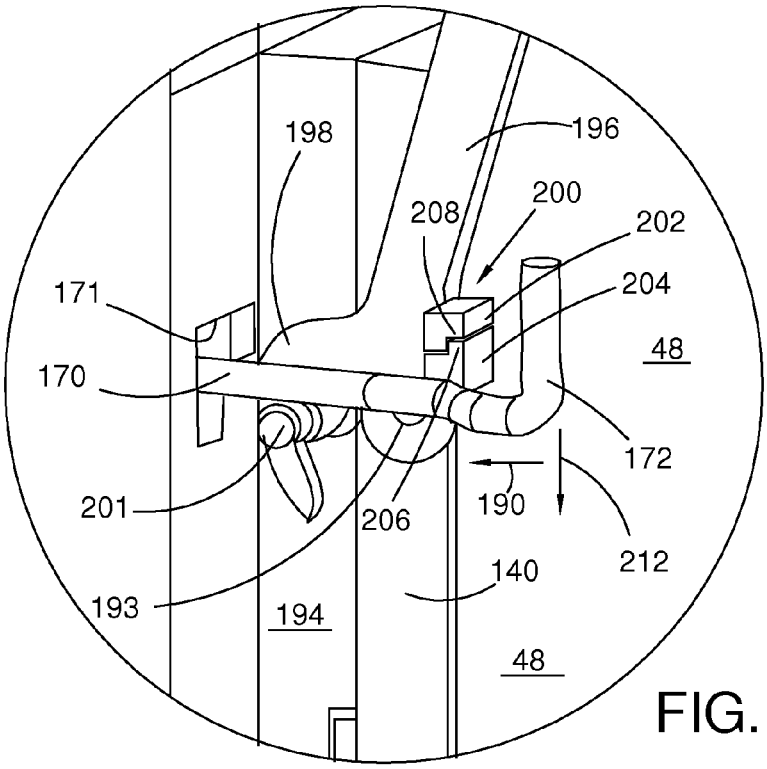
FIG. 15 is an enlarged partial view of the upper door opening mechanism.

Referring to FIGS. 15 and 20, a handle 191 is suitably rotatably mounted to the left side door flange 140 (for each door 48 and 50) by a suitable fastener 192 received in an aperture, illustrated at 193, in the handle 191 and in the aperture 142 (FIG. 21) in the door flange 140. The door opening is formed by forwardly extending flanges 194 from the forward wall, the flanges presenting the edges 165 for sealingly engaging the gasket or gaskets 164. The handle 191 includes a generally vertically upwardly extending handle portion 196 for application of leverage by the operator and a suitably shaped claw portion 198. One end of a suitable generally cylindrical member 201 is welded or otherwise suitably attached to the left side flange 194, in accordance with principles commonly known to those of ordinary skill in the art to which the present invention pertains, to receive the handle claw 198 in a manner to apply force to tightly sealingly close the door 48 (and similarly, door 50), by rotation of the handle portion 196 counterclockwise (as viewed in FIG. 15). By rotation of the handle portion 196 clockwise, the door 48 (and similarly, door 50) is opened.

As previously discussed, it is considered important that the upper door 48 not be opened until the damper 55 has been opened to relieve pressure in the upper chamber 42. Referring to FIGS. 15 and 20, in order to avoid accidental opening of the upper door 48 while the damper 55 is closed, in accordance with the present invention, a mechanism, illustrated generally at 200, is provided preventing the clockwise rotation of the handle 191 for opening the door 48 while the damper 55 is in a closed position with the rod 170 pulled rearwardly as seen in FIG. 15. The mechanism 200 comprises a pair of blocks 202 and 204 welded or otherwise suitably attached to the handle portion 196 (adjacent to its point 192 of attachment to the door 48) and rod 170 respectively in suitable positions, as seen in FIG. 15, to engage each other when the door 48 is closed and the damper 55 closed. The rod 170 is shown to be disposed laterally outwardly of the handle 191. The handle block 202 is welded to the handle 191 so as to extend laterally outwardly therefrom, and the rod block 204 is welded to the rod 170 so as to extend laterally inwardly therefrom such that major portions of the blocks 202 and 204 may engage each other without interference by the handle 191 or rod 170. Block 204 has a lip 206 extending upwardly from its upper forward corner which engages or is received in a mating cut-out, illustrated at 208, in the lower forward corner of the handle block 202. The lower surface of the block 202 rests on or engages the upper surface of block 204 with the lip 206 acting as a stop to movement of the block 202 forwardly and thus acts as a stop to clockwise movement of the handle 191 for opening the door 48. The rod 170 is spring-biased to retain the lip 206 in the cut-out 208 by a spring 210 (FIG. 16) having one end suitably attached to the rod 170 at a point located between the U-bolt 174 and the bracket 176 (the spring 210 extending downwardly therefrom and its other end suitably attached to the left outer wall 36) thereby, with the U-bolt 174 acting as a fulcrum, urging the forward end of rod 170 upwardly whereby the lip 206 is urged into engagement with the cut-out 208.

When it is desired to open the upper door 48 for loading of additional wood 62 or otherwise, the rod handle 172 is pushed downwardly, as indicated at 212, against the force of the spring 210, then pushed rearwardly, as indicated at 190, to open the damper 55. This clears the block 204 from acting as a stop, whereby with, the pressure relieved by the opening of the damper 55, the door 48 can now be safely opened. After the wood 62 is loaded and the door 48 closed, the damper 55 may be closed to allow the upper chamber 42 to again become pressurized for normal operation by pulling forwardly on the rod 170, using handle 172, until the lip 206 again engages cut-out 208 and is held therein by the bias force of spring 210, thereby again preventing the door 48 from being opened until the operator has taken steps to remove the impediment of the mechanism 200, which can be done by opening the damper 55 as discussed above. Other suitable mechanisms can be provided for insuring that the damper 55 is open before the door 48 is opened. Such other mechanisms are meant to come within the scope of the present invention.

Figure 25:
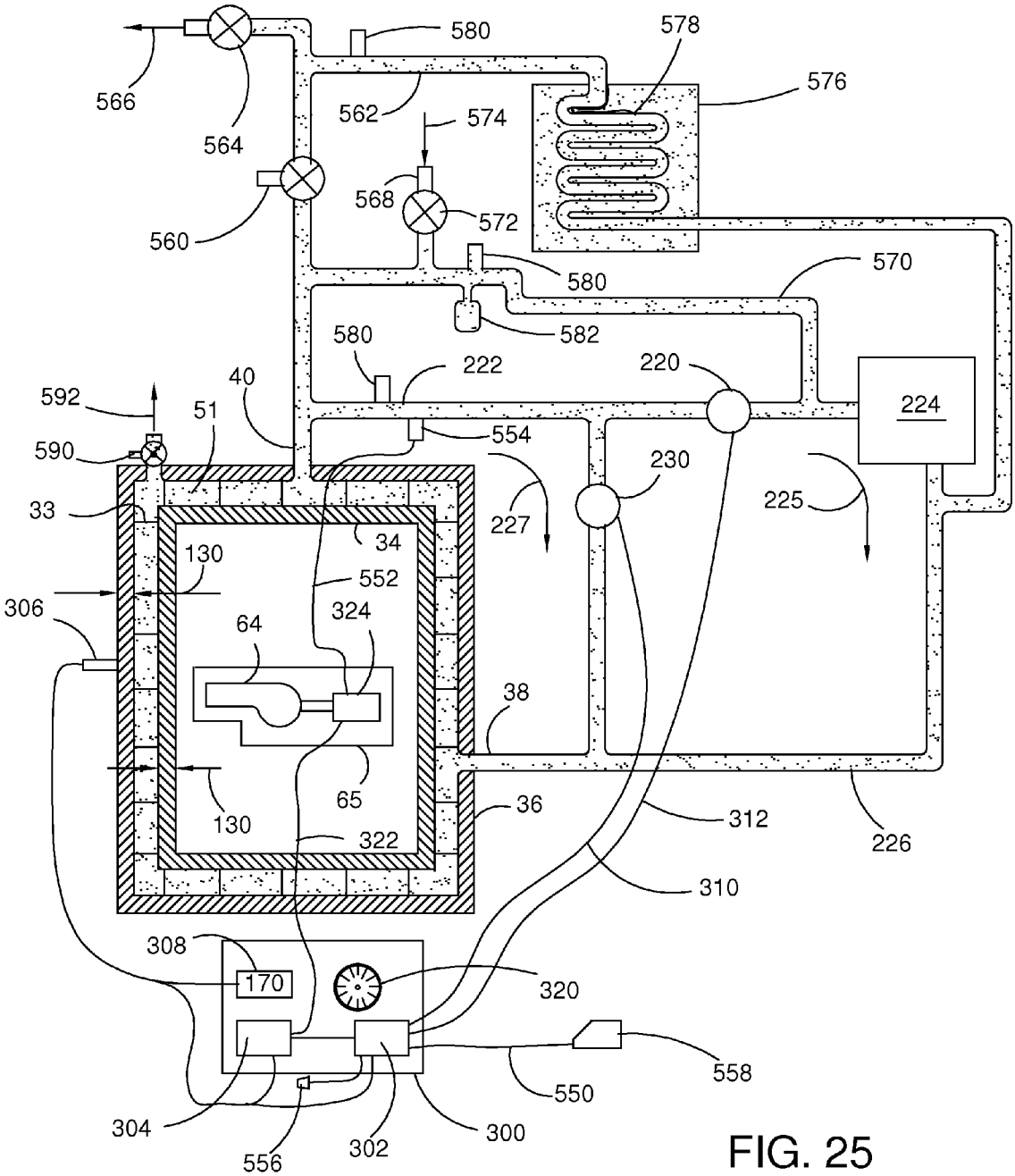
FIG. 25 is a schematic partially sectional view of the water flow path and temperature control for the boiler.
Figure 26:
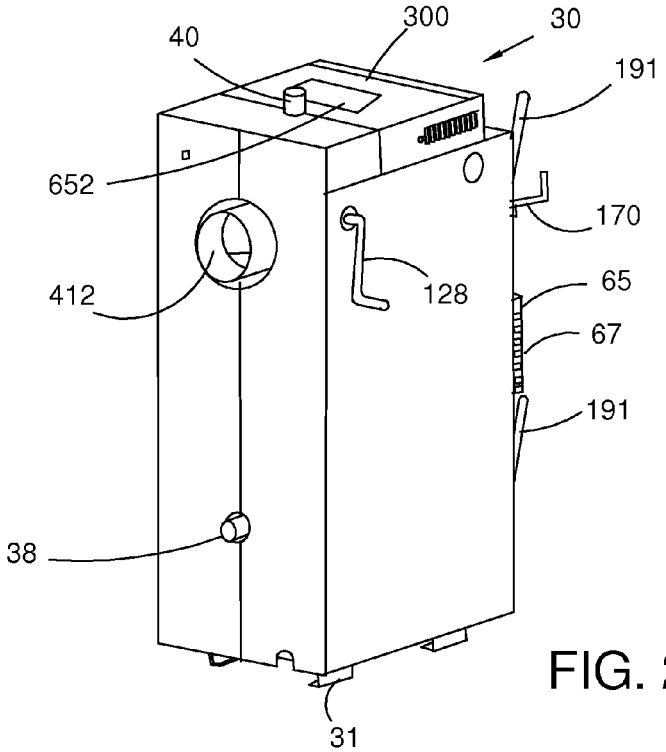
FIG. 26 is a perspective view of the boiler showing the rear, left side and top thereof.

Referring to FIG. 25, as previously discussed, the water 51 to be heated is contained between double walls 34 and 36, the inner wall 34 defining the interior of the firebox including the upper, rear, bottom, and side walls, and the wall portion between the doors 48 and 50. The inner wall 34 efficiently affords direct heat transfer from the heat generated in the firebox directly through the inner wall 34 to the water 51. When the water 51 is at the desired temperature for use, it is pumped, as illustrated at 225, by a suitable pump 220 from outlet line 222 to use points, indicated at 224, which may be primary or supplementary high volume heating and domestic hot water needs for commercial and residential applications, for example, for supply to a residential hot water heater or heating system. The water return is via a return line 226 to boiler inlet 38.

The pump 220 is normally off until the water 51 is at the desired temperature. In accordance with the present invention, a suitable circulation pump 230, which may be an electric or other suitable pump, is provided to internally circulate the water 51, as illustrated at 227, so that it is evenly heated throughout the water jacket for less thermal shock and longer life, i.e., the water is directly pumped from the water outlet 40 to the water inlet 38. By "directly" is meant that the use points 224 are by-passed by the flow of water from the outlet 40. Such internal circulation is also provided for more efficient operation by bringing the boiler up to temperature faster and thus better utilization of the fuel 62, i.e., not as much fuel is needed to get up to gasification temperature.

Because the upper chamber 42 is pressurized, it is important that gasification be suitably maintained as well as the water temperature regulated. The regulator therefor is illustrated at 300 and includes a suitable controller 302 and fan controller 304. The regulator unit 300 may utilize industrial grade touch pad control units, sold by Automation Direct Controls of Atlanta, Ga., to optimize the wood boiler's combustion efficiency. The controller 302 receives water temperature input from a temperature probe or thermocouple 306 suitably in contact with the outer wall 36 to obtain a measurement of water temperature. An LED display 308 of the water temperature may also be provided. The controller 302 is suitably programmed, utilizing principles commonly known to those of ordinary skill in the art to which the present invention pertains, to shut down the circulating pump, via line 310, and to turn on the primary pump 220, via line 312, at a predetermined set point, for example, about 130 degrees F. water temperature as measured by thermocouple 306.

In accordance with the present invention, the fan controller 304 is suitably programmed, using principles commonly known to those of ordinary skill in the art to which the present invention pertains, to control water temperature to the predetermined set point, illustrated at 320, of, for example, about 170 degrees F., by signaling via line 322 an AC (or other suitable) motor 324 powering the blower 64 to operate alternately at a high and a low speed, for example, to operate at a 100 percent output speed to increase temperature to the set point temperature, and to operate at a 50 percent output speed after the set point temperature has been reached to allow some drop in temperature below the set point temperature and thereafter again operating at the 100 percent output speed to again increase temperature to the set point temperature, etc., etc., thereby effecting an oscillating of the temperature near the set point temperature as is well known in the art to which the present invention pertains. By operating the blower 64 at the lower speed to allow the water temperature to decrease, the combustion process is continued during this period of time with the flame under control, without the necessity disadvantageously of having to periodically cease the combustion process. It should of course be understood that the blower motor 324 may be operated at various other higher and lower speed combinations as suitable to achieve the desired water temperature control.

A suitable aquastat or water temperature sensor 554 is suitably connected in the water flow line (as shown in the water outlet 40) using a suitable immersion well or as otherwise suitable and is suitably connected via line 552 to the blower motor 324 to turn off the blower 64 at a suitably programmed overheat set point of, for example, about 220 degrees F. water temperature. At the same set point temperature, the controller 302 is suitably programmed to effect the sounding of an alarm 556 and to turn off the primary pump 220 and turn on the circulating pump 230 (via lines 312 and 310 respectively) to dissipate heat and allow the water temperature to drop.

A line 562 is in parallel with the water usage units 224, and a suitable self-contained (i.e., not connected to an outside source of electrical power) valve 560 is installed in line 562 to sense water temperature and to automatically open to divert outlet water to a means for dissipating heat, as hereinafter described, at the above set point of, for example, about 220 degrees F. water temperature, this valve thus operating even in the event of power failure of outage. One means for dissipating heat is hand operated valve 564 downstream of valve 560 which releases the hot water as illustrated at 566, and cold or cooler make-up water from, for example, a city's water supply 568, is supplied to the system via valve 572 and line 570, as illustrated at 574. An alternative means of dissipating heat is by perculation through a water tank 576 in line 562 wherein the tank is installed at a location vertically higher than the boiler and the line is coiled to provide a submersible coil 578 inside the tank to suitably exchange heat in the outlet water to the water in the tank 576 to quickly dissipate heat. The tank 576 may have a capacity of, for example, 50 to 500 gallons, depending on the size of the boiler. If desired, a suitable hand operated valve, which should remain normally open if installed, may be installed in line 562, to be closed only when valve 564 is opened, and other valves may be located in the lines as suitable or desired. Suitable super vents 580 are suitably provided in highest points in the water lines to vent air. In line 570 a suitable shock-absorbing bladder 582 is installed to keep the water lines at suitably an even pressure of, for example, 20 psig. While one water pump 220 is shown for pumping the water through the load 224, it should be understood that it may be otherwise suitably positioned or other suitable pumps may be suitably installed as needed to assist and maintain suitable water flow. For example, pump 220 may alternatively be positioned at the water inlet 38.

In the event that the over-temperature device described above for turning off the blower at the overheat set point fails, a redundant control is provided for use at a higher temperature, as follows. The controller 302 is also suitably programmed to shut off system power, via line 550 to power supply 558, to thereby shut down the entire system at a water temperature of, for example, about 225 degrees F., including redundantly shutting off the blower 64, eliminating the flow of air/oxygen to the fire box, which will then redundantly allow the fire therein to smolder.

Illustrated at 590 is a suitable safety or pop-off valve which is installed through the outer water jacket wall 36 in flow communication with the water therein and which is set to open at a pressure of about 30 psig (or other suitable pressure) to release pressure/steam from the water jacket, as illustrated at 592, in the event of failure of the safety shut-off systems at the lower temperatures (at 220 and 225 degrees F.) discussed above. The valve 590 may, for example, be one identified as model number 335M1 sold by Watts Regulator Company of North Andover, Mass.

Referring to FIG. 29, there is illustrated at 600 refractory blocks which have an alternative shape to the refractory blocks 78 of FIG. 28. These refractory blocks 600 are illustrated to have a reduced height, illustrated at 602, above the floor 612 to allow a smoother, more even, bed of coals to form and to eliminate "bridging" of the wood 62 in the upper combustion chamber 42. "Bridging" occurs when wood 62 in the bottom of the upper combustion chamber 42 burns up but wood 62 in the upper portion thereof that does not fall "bridges" together and may as a result not burn.

Figure 35:
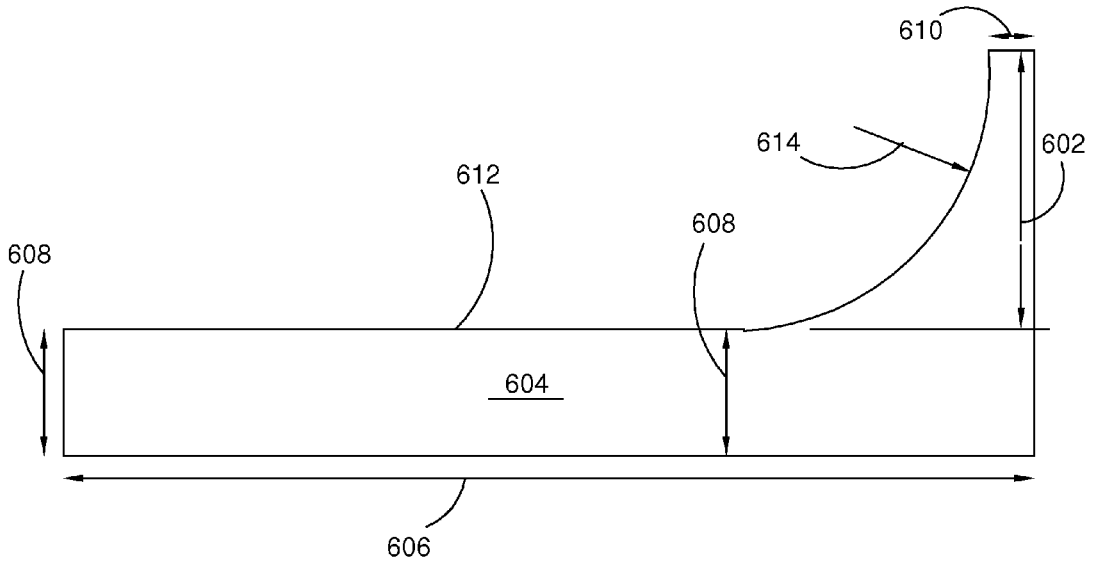
FIG. 35 is an enlarged side view of an alternative embodiment of the upper chamber refractory of FIG. 29.

Referring to FIG. 35, there is illustrated at 604 another example of a refractory block suitable for prevention of such "bridging." Refractory block 604 has a width, illustrated at 606, which is roughly equal to the distance between the nozzle block 76 and the boiler wall 34, for example, about 7.75 inches, it being understood that refractory mortar may be laid and cured between the refractory block 604 and the boiler wall 34. This width 606 will vary depending on the size (width) of the boiler 30. Its height, illustrated at 608, at the nozzle block 76 may be, for example, about 1 inch, and this height remains constant over a distance which will also vary according to boiler size and is shown in the example of FIG. 35 to remain constant over approximately ⅔ of the width 606. Its thickness, illustrated at 610, at its highest point adjacent the boiler wall 34 is, for example, about 0.375 inch. The block upper surface or floor, illustrated at 612, upon which wood 62 is placed for burning, is curved adjacent the boiler wall 34 by a radius, illustrated at 624, of, for example, about 2 inches. Height 602 adjacent the boiler wall 34 of the block above the floor 612 is, for example, about 2.25 inches (with the overall block height being about 3.25 inches). In order to prevent "bridging," it is important that this height 602 (over which the block extends above the floor 612) not be too high. Thus, no matter what the boiler size, it is important, for the prevention of "bridging," that the height 602 be less than about 2¼ inches. It should of course be understood that the refractory block 604 may be otherwise suitably sized and shaped, such as illustrated in FIG. 29.

Referring to FIGS. 29 and 30, there is shown at 620 a lower combustion chamber refractory block having an alternative shape. In order to provide greater ease of cleaning and servicing of the boiler 30 with no change in emissions, the refractory block 620 is flat and tapered from rear to front (towards the door 50) of the boiler 30. For example, the height, illustrated at 622, of the refractory block 620 is about 2 inches, and it tapers to a height, illustrated at 624, at the front which is about 1 inch. The forward downward slope of the refractory block 620 is believed to cause the particulates to be deflected forwardly before they are deflected rearwardly for more resonance time for scrubbing emissions (carbon monoxide, etc.). In addition, ash is forced more forwardly to thereby reduce particulates being forced up the stack.

Figure 31:
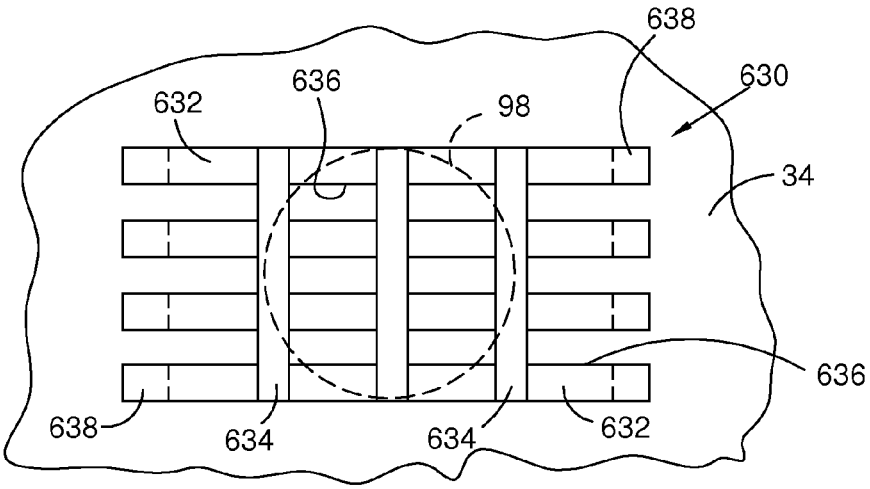
FIG. 31 is a partial view of the inner rear wall of the boiler and illustrating a flue guard.
Figure 32:
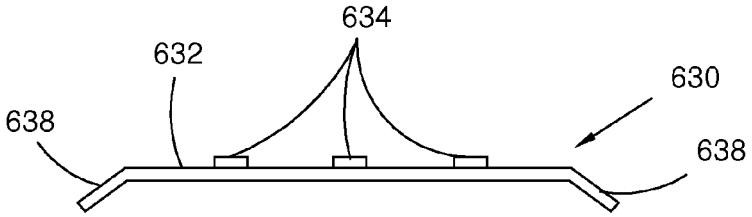
FIG. 32 is a lower edge view of the flue guard.

It has been discovered that wood may sometimes be thrown up into an unguarded flue (damper opening 98) thus rendering the flue damper or blast gate 55 inoperative. Referring to FIGS. 31 and 32, a flue guard 630 in the form of a grate or grid is welded (or otherwise suitably attached) to the inner surface or fire side of boiler wall 34 to protectively cover the damper opening 98. As seen in FIGS. 31 and 32, the grid 630 includes a plurality (such as, for example, four) of spaced horizontal steel strips 632 and a plurality (such as, for example, three) of spaced vertical steel strips 634 which cross the horizontal strips 632 and are welded (or otherwise suitably attached) thereto, thereby leaving a plurality of flue passages, illustrated at 636. The end portions 638 of the horizontal strips are uniformly bent so as to space the grid 630 from the damper opening 98, and it is these bent portions 638 that are welded (at their ends) to the boiler wall 34. The grid 630 may of course be otherwise suitably sized and shaped. For example, the vertical strips 634 could alternatively be welded to the boiler wall 34.

Figure 33:
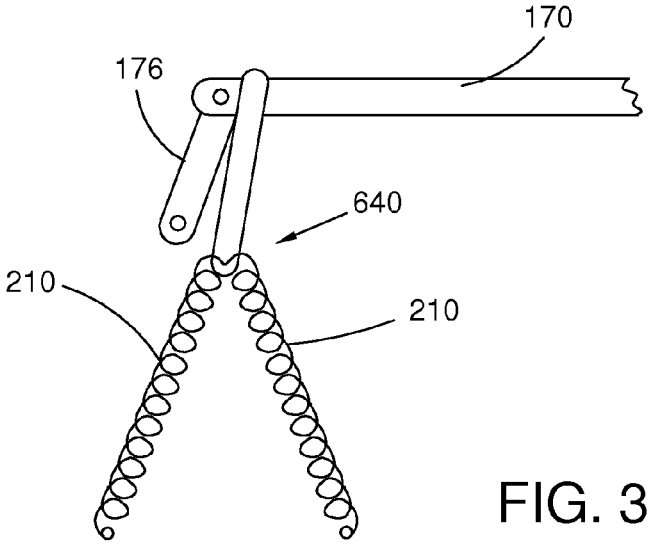
FIG. 33 is a partial view of the boiler illustrating an alternative embodiment of the spring mechanism illustrated in FIG. 16.

Referring to FIG. 33, there is illustrated an alternative embodiment of the spring biasing mechanism for retaining the lip 206 in the cut-out 208 (FIG. 15) so that the upper door 48 is not opened until the damper 55 has been opened to relieve pressure in the upper combustion chamber 42. The spring mechanism, illustrated generally at 640, is positioned adjacent the rear end of the rod (adjacent the link 176) and is provided with two springs 210 attached to bracket 642, which is suitably attached to the rod 170, and which are offset as they extend downwardly (one spring 210 inclined forwardly and the other inclined rearwardly) in order to provide for both a positive opening and a positive closing of the damper 55 while also retaining the lip 206 in the cut-out 208 (FIG. 15) so that the upper door 48 is not opened until the damper 55 has been opened to relieve pressure in the upper combustion chamber 42.

During production, the boiler 30 is moved around by means of a hook, illustrated at 650 (FIG. 16), attached to the outer casing 36. When the regulator housing 300 is thereafter installed, this hook 650 is rendered unavailable. Referring to FIGS. 5, 14, 19, and 26, the housing 300 is provided with a removable panel 652 (for example, 10 inches by 10 inches) to allow the installer the ability to gain access to the hook 650 to move the boiler 30 around and thus make their installations easier.

Referring to FIG. 34, there is illustrated at 660 an optional thermal storage tank which it has been suggested may be installed, if desired, to store heat energy during low heat usages for use during peak heat usage times. The tank contains water, illustrated at 662, which remains in the tank 660 and copper coils for transferring heat from the boiler 30 to the water 662 for storage thereof and for transferring heat from the water 662 for usage thereof, allowing the boiler 30 to run at full capacity yielding the most efficient burn with the least amount of produced emissions. The tank 660 has a boiler side coil 664 for receiving heated water from the boiler 30, via line 666, as illustrated at 670, when valve 668 is open (and valve 672 closed), and in heat exchange with the tank water 662, delivering heat therein to the tank water 662 for storage of the heat. The heat depleted water from coil 664 is then returned to the boiler 30 via line 674, as illustrated at 676, to be re-heated. When heat in the tank water 662 is to be used, water is flowed through use side coil 678 via inlet and outlet lines, illustrated at 680 and 682 respectively, as illustrated at 684, with inlet and outlet valves 686 and 688 respectively open and valve 672 closed, with the water 662 giving up its heat to the water flowing through the coil 678 in heat exchange relation therewith for use. Heated water from the boiler 30 may be directed used by closing valves 668, 686, and 688 and opening valve 672. The heat storage tank 660 may be of any suitable size and shape and construction, for example, one marketed by STSS Co., Inc. of Mechanicsburg, Pa. and one marketed by Bioheat USA of Lyme, N.H.

It should be understood that, while the present invention has been described in detail herein, the invention can be embodied otherwise without departing from the principles thereof, and such other embodiments are meant to come within the scope of the present invention as defined by the appended claims.

What is claimed is:

1. A boiler comprising an inner casing, an outer casing defining with said inner casing a space in which fluid can be received for heating thereof, a fluid inlet to the space, a fluid outlet from the space, a refractory structure in said inner casing and defining an upper combustion chamber and a lower combustion chamber in said inner casing, at least one vertical passage through said refractory structure for flowing combustion gases from said upper combustion chamber to said lower combustion chamber, at least one first forced air inlet to said upper combustion chamber for providing oxygen for burning of material in said upper combustion chamber, at least one forced air passage in said refractory structure and opening into said vertical passage thereby providing at least one second forced air inlet to said vertical passage for providing oxygen in said vertical passage for burning of the combustion gases and particulates passing therethrough from said upper combustion chamber, wherein said refractory structure extends entirely across and sealingly engages said inner casing in a manner to seal said upper combustion chamber from said lower combustion chamber so that said upper combustion chamber can be made substantially air tight whereby said upper combustion chamber can be pressurized by forced air thereto to effect expulsion of combustion gases and particulates from said upper combustion chamber through said at least one vertical passage for burning thereof, and refractory material disposed in said lower combustion chamber and having an upper surface positioned so that the burning combustion gases and particulates expelled through said at least one vertical passage impinge on said upper surface.

2. A boiler according to claim 1 further comprising an exhaust passage including at least one flow restricting tube.

3. A boiler according to claim 1 further comprising a pump connected for pumping the fluid from the fluid outlet directly to the fluid inlet.

4. A boiler according to claim 1 wherein both of said inner and outer casing are composed of the same material.

5. A boiler according to claim 1 wherein both of said inner and outer casing are composed of boiler plate having a thickness of at least about ¼ inch.

6. A boiler according to claim 1 further comprising doors hingedly attached to the boiler to open and close said upper and lower combustion chambers respectively, wherein at least one of said doors comprises a first plate having an outer surface which defines an exterior of the door and having an inner surface, a second plate spaced inwardly from said first plate and having inner and outer surfaces, a block of refractory material attached to said inner surface of said second plate, and insulation material disposed between said first and second plates.

7. A boiler according to claim 1 further comprising a damper which is closable to thereby seal said upper combustion chamber and which is openable to relieve pressure in said upper combustion chamber, a rod connected to said damper and having a handle for pushing and pulling said rod for opening and closing said damper, a door to said upper combustion chamber, a handle pivotally attached to said door for opening and closing said door, and members on said rod and said door handle respectively which are engageable when said door is closed to prevent movement of said door handle to open said door when said rod is in a position such that said damper is closed and which are disengagable to allow movement of said rod to a position opening said damper.

8. A boiler according to claim 1 further comprising at least one forced draft fan for supplying air to said first and second forced air inlets, at least one electric motor for operating said at least one forced draft fan, and means for operating said electric motor between a first speed for increasing the liquid temperature to a set point temperature and a second speed which is a reduced speed for maintaining combustion without the liquid temperature being increased above the set point temperature.

9. A boiler according to claim 1 wherein said refractory structure includes at least one layer of laid refractory material containing said at least one forced air passage, a block of refractory material set into said laid refractory material and containing said vertical passage, and a plurality of blocks of refractory material set into said laid refractory material and defining an upper refractory structure surface for receiving wood or biomass.

10. A boiler according to claim 1 wherein said refractory structure includes at least one layer of laid refractory material containing said at least one forced air passage, a first block of refractory material set into said laid refractory material and containing said vertical passage, and a plurality of second blocks of refractory material set into said laid refractory material and defining an upper refractory structure floor for receiving wood or biomass and which slopes upwardly from said first block toward said inner casing in a manner to prevent bridging of the wood or biomass.

11. A boiler according to claim 10 wherein said floor extends upwardly over a distance of less than about 2¼ inches.

12. A boiler according to claim 1 wherein said refractory material upper surface is inclined downwardly form rear to front of the boiler.

13. A method of heating a fluid comprising the steps of:

(a) providing a fuel in an upper combustion chamber which is within an inner casing, wherein the upper combustion chamber is sealingly separated from a lower combustion chamber within the inner casing by a refractory structure which has at least one vertical passage which allows flow of combustion gases and particulates from the upper combustion chamber to the lower combustion chamber;

(b) flowing a fluid to be heated through a space between the inner casing and an outer casing to thereby receive heat through the inner casing;

(c) initiating burning of the fuel;

(d) effecting sealing of the upper combustion chamber;

(e) providing a forced air flow to the upper combustion chamber thereby providing oxygen for burning the fuel and thereby expelling combustion gases and particulates from the sealed upper combustion chamber downwardly through the at least one vertical passage;

(f) providing a forced air flow through at least one passage in the refractory structure to the at least one vertical passage to effect burning of the combustion gases and particulates being expelled therethrough; and (g) effecting impinging of the burning combustion gases and particulates on refractory material in the lower combustion chamber.

* * * * *